US007857389B2

(12) United States Patent
Ueda

(10) Patent No.: US 7,857,389 B2
(45) Date of Patent: Dec. 28, 2010

(54) STRUCTURE FOR CONNECTING MEMBERS

(75) Inventor: Nobuyuki Ueda, Osaka (JP)

(73) Assignee: Kokuyo Furniture Co., Ltd, Osaka-shi (JP)

( * ) Notice: Subject to any disclaimer, the term of this patent is extended or adjusted under 35 U.S.C. 154(b) by 0 days.

(21) Appl. No.: 12/688,325

(22) Filed: Jan. 15, 2010

(65) Prior Publication Data

US 2010/0117422 A1 May 13, 2010

Related U.S. Application Data

(62) Division of application No. 11/594,834, filed on Nov. 9, 2006, now Pat. No. 7,712,833.

(30) Foreign Application Priority Data

Nov. 11, 2005 (JP) ..... 2005-328209

(51) Int. Cl.
*A47C 3/00* (2006.01)

(52) U.S. Cl. ..... 297/296; 297/440.2; 297/354.11

(58) Field of Classification Search ..... 297/440.2, 297/296, 354.11
See application file for complete search history.

(56) References Cited

U.S. PATENT DOCUMENTS

| | | | |
|---|---|---|---|
| 293,813 | A | 2/1884 | St John |
| 2,083,838 | A | 6/1937 | Goenen |
| 2,538,507 | A | 1/1951 | Cramer |
| 3,133,763 | A | 5/1964 | Stoll et al. |
| 3,938,858 | A | 2/1976 | Drabert et al. |
| 4,090,700 | A | 5/1978 | Davis |
| 4,549,764 | A | 10/1985 | Haedo |
| 4,575,150 | A | 3/1986 | Smith |
| 4,640,548 | A | 2/1987 | Desanta |
| 4,709,963 | A | 12/1987 | Uecker et al. |
| 4,830,430 | A | 5/1989 | Schafer |

(Continued)

FOREIGN PATENT DOCUMENTS

| | | | |
|---|---|---|---|
| DE | 19930922 | A1 | 5/2000 |

(Continued)

OTHER PUBLICATIONS

European Office Action dated Mar. 29, 2007, Application No. 06123872.1-1258 of co-pending U.S. Appl. No. 11/594,835.

(Continued)

*Primary Examiner*—Anthony D Barfield
(74) *Attorney, Agent, or Firm*—Westerman, Hattori, Daniels & Adrian, LLP

(57) ABSTRACT

The present invention intends to arrange the appearance of furniture at a connecting portion between a first member having stiffness and a second member movable relative to the first member and having stiffness without forming the connecting portion in an unnaturally large diameter. More specifically, the present invention provides a structure for connecting members comprising: a first member having stiffness; a second member movable relative to the first member and having stiffness; and a spring member in which an end portion thereof is connected to the first member and other end portion thereof is connected to the second member so as to accumulate a reaction force by elastic deformation, wherein the spring member is formed into a frame-like shape extending along the first and second members.

4 Claims, 19 Drawing Sheets

U.S. PATENT DOCUMENTS

| | | | |
|---|---|---|---|
| 4,834,453 | A | 5/1989 | Makiol |
| 4,869,552 | A | 9/1989 | Tolleson et al. |
| 5,046,780 | A | 9/1991 | Decker et al. |
| 5,172,930 | A | 12/1992 | Boye et al. |
| 5,249,839 | A | 10/1993 | Faiks et al. |
| 5,348,372 | A | 9/1994 | Takamatsu et al. |
| 5,385,388 | A | 1/1995 | Faiks et al. |
| 5,649,739 | A | 7/1997 | Zapf |
| 5,904,397 | A | 5/1999 | Fismen |
| 5,951,109 | A | 9/1999 | Roslund, Jr. et al. |
| 5,988,746 | A | 11/1999 | Raftery |
| 6,050,646 | A | 4/2000 | Stenzel et al. |
| 6,056,361 | A | 5/2000 | Cvek |
| 6,086,153 | A | 7/2000 | Heidmann et al. |
| 6,116,687 | A | 9/2000 | Vogtherr |
| 6,120,097 | A | 9/2000 | Perry et al. |
| 6,149,236 | A | 11/2000 | Brauning |
| 6,189,971 | B1 | 2/2001 | Witzig |
| 6,220,661 | B1 | 4/2001 | Peterson |
| 6,257,665 | B1 | 7/2001 | Nagamitsu et al. |
| 6,406,096 | B1 | 6/2002 | Barile, Sr. |
| 6,439,661 | B1 | 8/2002 | Brauning |
| 6,460,928 | B2 | 10/2002 | Knoblock et al. |
| 6,517,156 | B1 | 2/2003 | Lin |
| 6,523,898 | B1 | 2/2003 | Ball et al. |
| 6,565,153 | B2 | 5/2003 | Hensel et al. |
| 6,572,190 | B2 | 6/2003 | Koepke et al. |
| 6,609,755 | B2 | 8/2003 | Koepke et al. |
| 6,672,669 | B2 | 1/2004 | Chu et al. |
| 6,695,403 | B1 | 2/2004 | Su |
| 6,695,404 | B2 | 2/2004 | Bruske |
| 6,729,688 | B2 | 5/2004 | Erne |
| 6,761,406 | B2 | 7/2004 | Kinoshita et al. |
| 6,767,066 | B1 | 7/2004 | Tornero |
| D497,264 | S | 10/2004 | Aubriet et al. |
| 6,811,215 | B2 | 11/2004 | Horiki et al. |
| 6,843,530 | B1 | 1/2005 | Wu |
| 6,913,316 | B2 | 7/2005 | Kinoshita et al. |
| 6,991,291 | B2 | 1/2006 | Knoblock et al. |
| 7,014,269 | B2 | 3/2006 | Coffield et al. |
| 7,066,537 | B2 | 6/2006 | Coffield et al. |
| 7,118,176 | B2 | 10/2006 | Erker |
| 7,134,722 | B2 | 11/2006 | Ueda et al. |
| 7,226,127 | B1 | 6/2007 | Yevko et al. |
| 7,273,253 | B2 | 9/2007 | Deimen et al. |
| 7,396,079 | B2 | 7/2008 | Heidmann et al. |
| 7,422,287 | B2 | 9/2008 | Heidmann et al. |
| 7,434,879 | B2 | 10/2008 | Ueda et al. |
| 2002/0117883 | A1 | 8/2002 | Gevaert |
| 2002/0180248 | A1 | 12/2002 | Kinoshita et al. |
| 2002/0180250 | A1 | 12/2002 | Kinoshita et al. |
| 2002/0180252 | A1 | 12/2002 | Kinoshita et al. |
| 2002/0190553 | A1 | 12/2002 | Koepke et al. |
| 2002/0190555 | A1 | 12/2002 | Holbrook et al. |
| 2003/0127896 | A1 | 7/2003 | Deimen et al. |
| 2004/0012237 | A1 | 1/2004 | Horiki et al. |
| 2004/0066075 | A1 | 4/2004 | Yeh |
| 2004/0140701 | A1 | 7/2004 | Schmitz et al. |
| 2004/0183350 | A1 | 9/2004 | Schmitz et al. |
| 2007/0108819 | A1 | 5/2007 | Ueda |
| 2007/0108820 | A1 | 5/2007 | Ueda et al. |
| 2007/0108821 | A1 | 5/2007 | Ueda |
| 2007/0108822 | A1 | 5/2007 | Ueda |
| 2007/0108831 | A1 | 5/2007 | Ueda |
| 2008/0030059 | A1 | 2/2008 | Deimen et al. |

FOREIGN PATENT DOCUMENTS

| | | | |
|---|---|---|---|
| DE | 10147021 | A1 | 4/2003 |
| EP | 0259609 | A2 | 3/1988 |
| EP | 0552388 | A1 | 7/1993 |
| EP | 1447029 | A1 | 8/2004 |
| FR | 2627968 | A1 | 9/1989 |
| GB | 610741 | A | 10/1948 |
| GB | 2143730 | A | 2/1985 |
| JP | 61-041028 | A | 2/1986 |
| JP | 2616332 | A | 6/1997 |
| JP | 2002119373 | A | 4/2002 |
| JP | 2002119375 | A | 4/2002 |
| JP | 2003-265256 | A | 9/2003 |
| NL | 7804978 | A | 11/1978 |
| WO | 86/02243 | A1 | 4/1986 |
| WO | 94/27472 | A1 | 12/1994 |
| WO | 00/22961 | A1 | 4/2000 |

OTHER PUBLICATIONS

European Search Report dated Feb. 1, 2007, issued in corresponding Ep 06 12 3869 of co-pending U.S. Appl. No. 11/594,837.

European Search Report dated Feb. 16, 2007, issued in corresponding application EP 06 12 3871.

European Search Report mailed Mar. 12, 2007, issued in corresponding appliacation EP 06 12 3874.

European Search Report dated Jan. 30, 2007, issued in corresponding European Application No. 06 12 3875 of co-pending U.S. Appl. No. 11/594,836.

European Search Report dated Apr. 16, 2007, issued in corresponding EP application No. 06-123876.2-1258 of co-pending U.S. Appl. No. 11/594,858.

STRUCTURE FOR CONNECTING MEMBERS

INCORPORATED-BY-REFERENCE TO RELATED APPLICATIONS

This application is a divisional application of U.S. Ser. No. 11/594,834, filed Nov. 9, 2006, and is based upon and claims the benefit of priority from the prior Japanese Patent Application No. 2005-328209, filed on Nov. 11, 2005, the entire contents of which are incorporated by reference.

BACKGROUND OF THE INVENTION

1. Field of the Invention

The present invention relates to a structure for connecting members wherein a first member is connected to a second member movable relative to the first member via a spring member capable of storing a reaction force by elastic deformation.

2. Description of the Related Art

As a structure for connecting a first member having stiffness and a second member movable relative to the first member and having stiffness via a spring member disposed between the first and second members and capable of accumulating reaction force by elastic deformation, a variety of examples have been contemplated. For example, a structure in which the first member and second member are connected pivotably at their end portions and a twisting coil spring is disposed at this pivoting portion has been contemplated (see for example Japanese Patent No. 2616332 (see particularly paragraph 0020)).

Then, in the structure described in the Japanese Patent No. 2616332, the twisting coil spring needs to be disposed as well as a pivoting shaft on which the first and second members are connected, between the first and second members. If such a twisting coil spring is exposed outside, substance may go into between the twisting coil spring and pivoting shaft so that a relative movement between the first and second members becomes unsmooth, which is a problem to be solved. On the other hand, if a cover for wrapping such a twisting coil spring is provided, that cover needs to be provided in the vicinity of the pivoting shaft, so that apparently the diameter near the pivoting shaft increases largely as compared with the widths of the first and second members thereby generating such a disadvantage that its appearance is poor to see.

SUMMARY OF THE INVENTION

Accordingly, the present invention intends to provide a structure capable of arranging the appearance of furniture having a spring member neatly in order to solve the above problem.

To achieve the above object, the present invention provides a structure for connecting members comprising: a first member having stiffness; a second member movable relative to the first member and having stiffness; and a spring member in which an end portion thereof is connected to the first member and other end portion thereof is connected to the second member so as to accumulate a reaction force by elastic deformation, wherein the spring member is formed into a frame-like shape extending along the first and second members.

Consequently, the connecting portion between the spring member and the first member and the connecting portion between the spring member and the second member can adopt a structure in which the spring member is installed to the first member or the second member with screws or the spring member and the first member or the second member are formed integrally. As a result, a construction near the connecting portion is not formed in an unnaturally large diameter and the appearance of furniture can be arranged neatly by constructing the spring member so that it looks as part of the first and second members.

Particularly, if both the first member and the second member is frame-like member and the spring member is disposed substantially parallel to the first member and the second member, a portion in which the first and second frame member and the spring member are disposed is constructed into a shape in which two frame-like members are disposed substantially parallel to each other and consequently, feeling of disharmony on the appearance due to installation of the spring member can be reduced.

If the first member and the second member are pivoted to each other at end portions thereof, the pivoting portion can be prevented from being formed into an unnaturally large diameter by connecting the spring member to the first member and the second member instead of providing the pivoting portion with a torsion coil spring.

As an embodiment capable of securing the above-mentioned advantages preferably, the first member is lower frame element constituting a backrest lower portion of a chair and the second member is upper frame element constituting a backrest upper portion of the chair. Consequently, a structure which allows the upper portion of the backrest to be tilted backward following up a seated person's movement of warping his or her back and when the movement of warping his or hers back ends, a condition in which a reaction force is accumulated in the spring member to be released can be achieved without damaging the neat appearance of the chair seriously.

Particularly as an embodiment capable of following up seated person's movement of turning around his or her body to warp only one side of the back, a structure having at least a back frame including at least a pair of the lower frame elements on the right and left, at least a pair of the upper frame elements on the right and left in which bottom ends thereof are pivoted to top ends of the lower frame elements and at least a pair of the spring members on the right and left for connecting the lower frame element to the upper frame member, and the right and left upper frame elements being capable of tilting independently, can be mentioned.

On the other hand, as a structure capable of easily obtaining an effect that the reaction force applied to the backrest is increased as the backrest is tilted backward largely, a structure that the first member is a base body which supports a seat and backrest of a chair and the second member is a back frame constituting at least part of the backrest of the chair.

The expression "frame-like spring member" mentioned in the present invention is a concept including generally a phenomenon that the spring member is formed extending along the first and second members.

Because if the structure for connecting members of the present invention is adopted, the structure for installing the spring member to the first member or the second member with screws or the like or forming the spring member and the first member or the second member integrally can be adopted for a connecting portion between the spring member and the first member and a connecting portion between the spring member and the second member, the appearance of the furniture can be arranged neatly without forming the construction near the connecting portion into an unnaturally large diameter.

DESCRIPTION OF THE PREFERRED EMBODIMENTS

Figure 1:
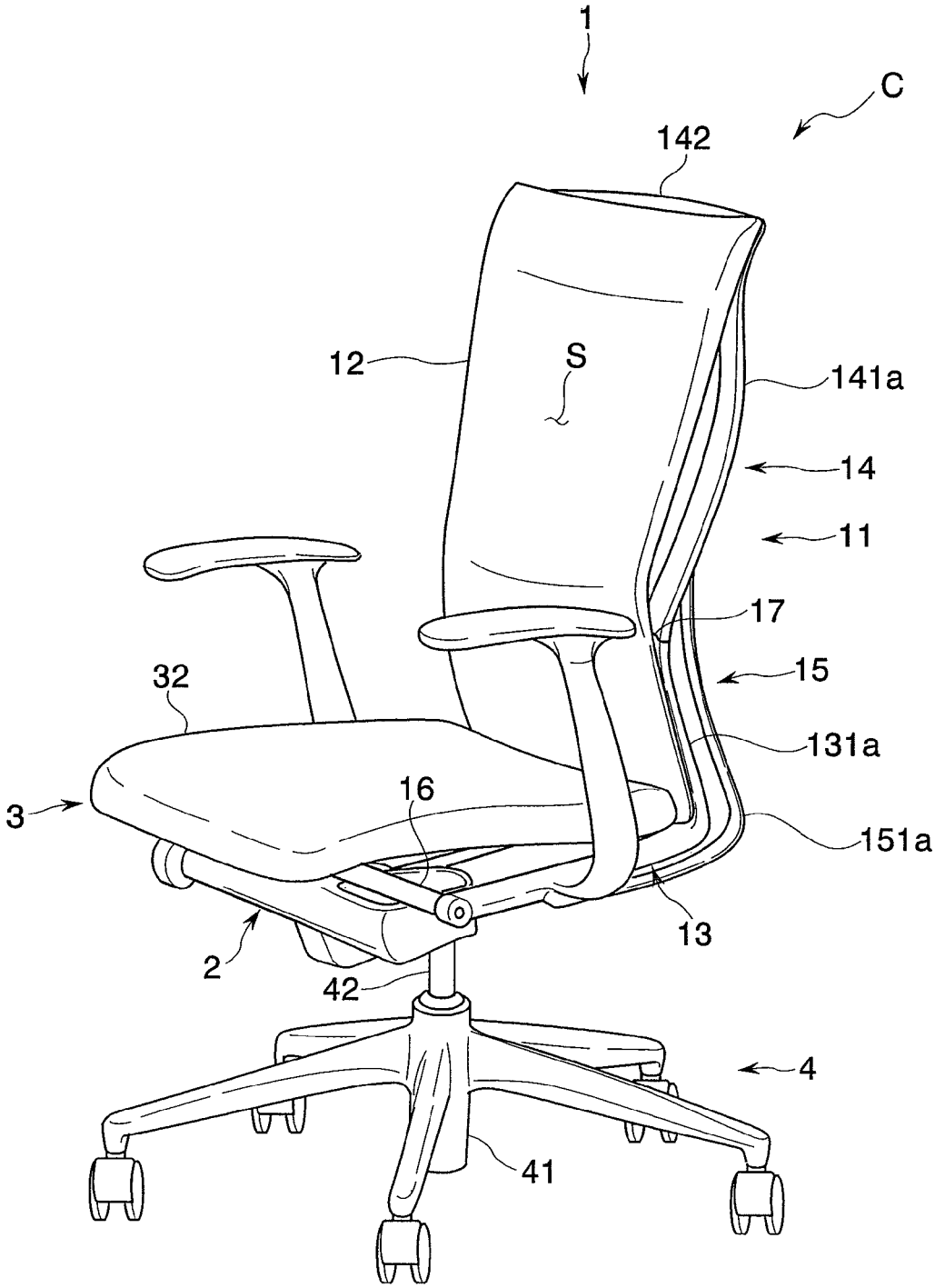
FIG. 1 is a perspective view of a chair according to an embodiment of the present invention as seen from the front side.
Figure 2:
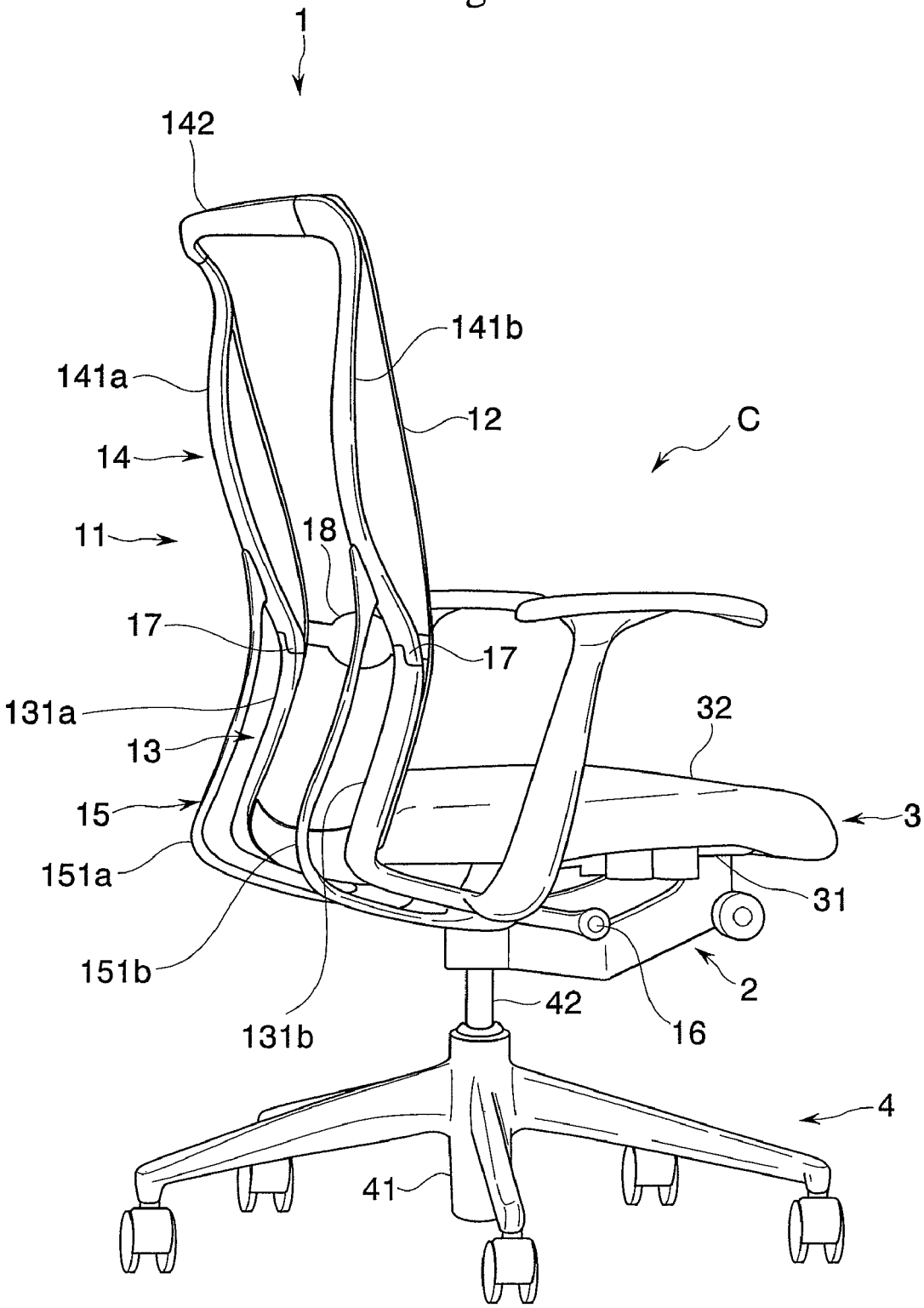
FIG. 2 is a perspective view of the chair according to the same embodiment as seen from the back side.
Figure 3:
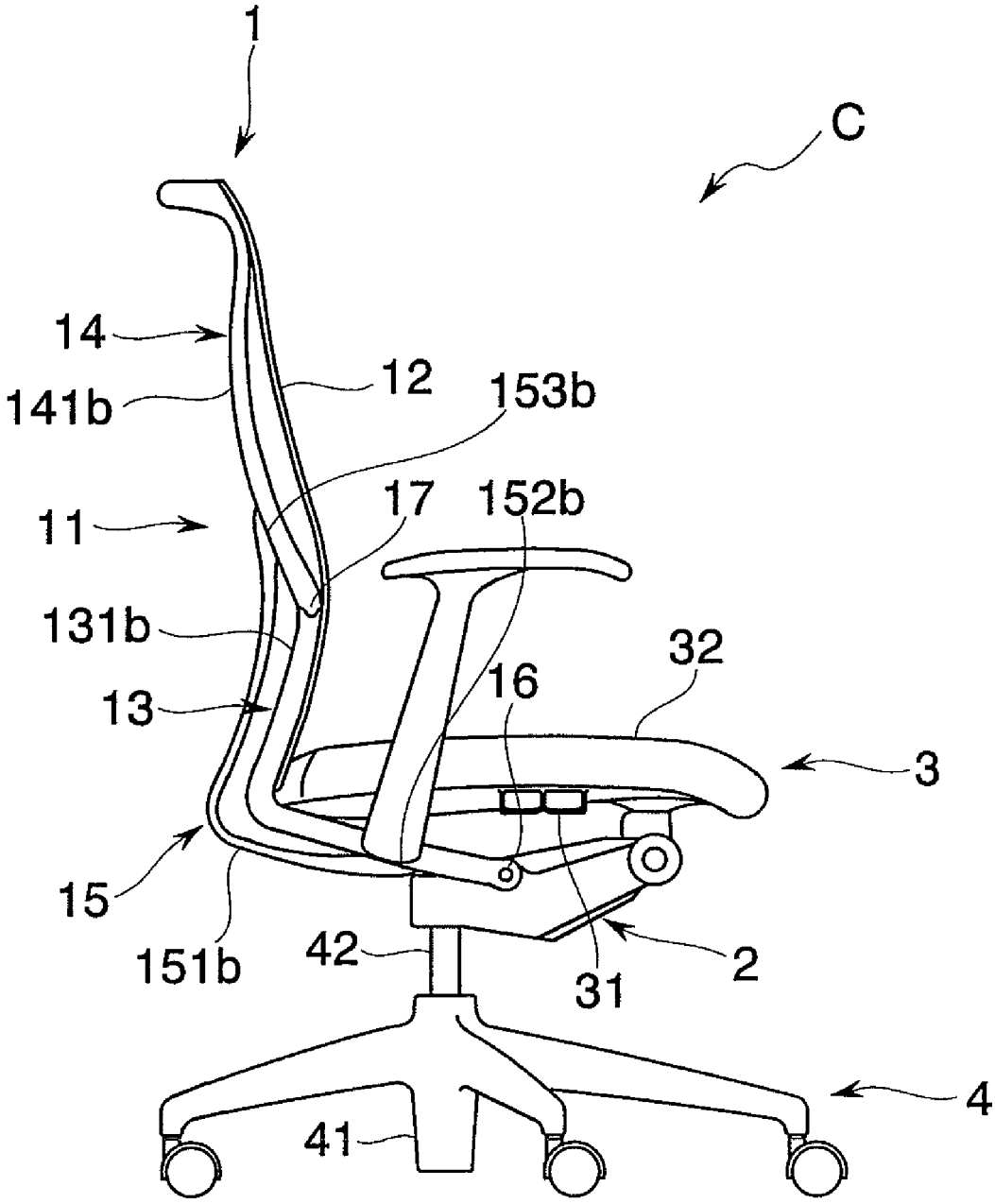
FIG. 3 is a side view of the chair according to the embodiment.
Figure 4:
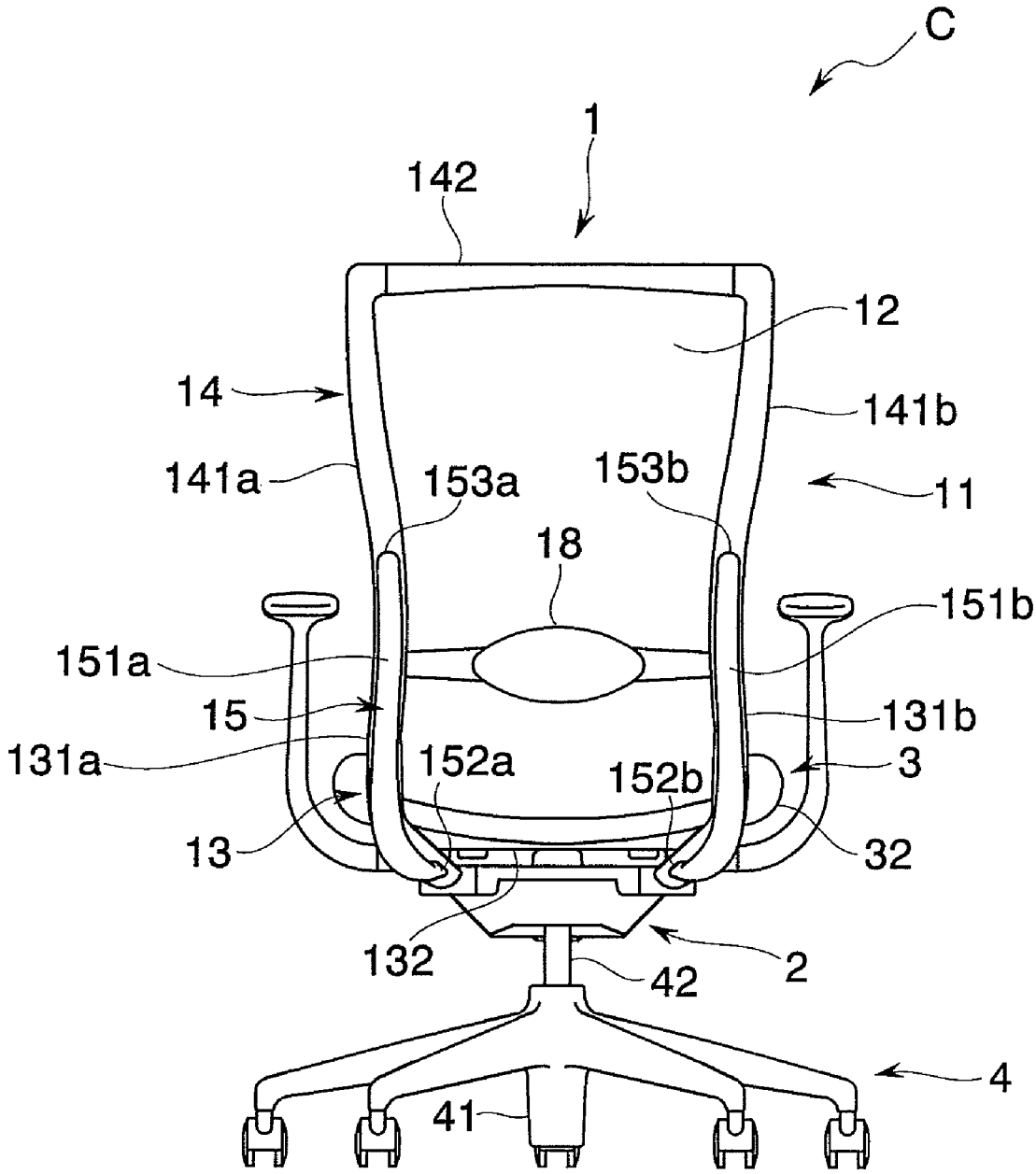
FIG. 4 is a rear view of the chair according to the embodiment.
Figure 5:
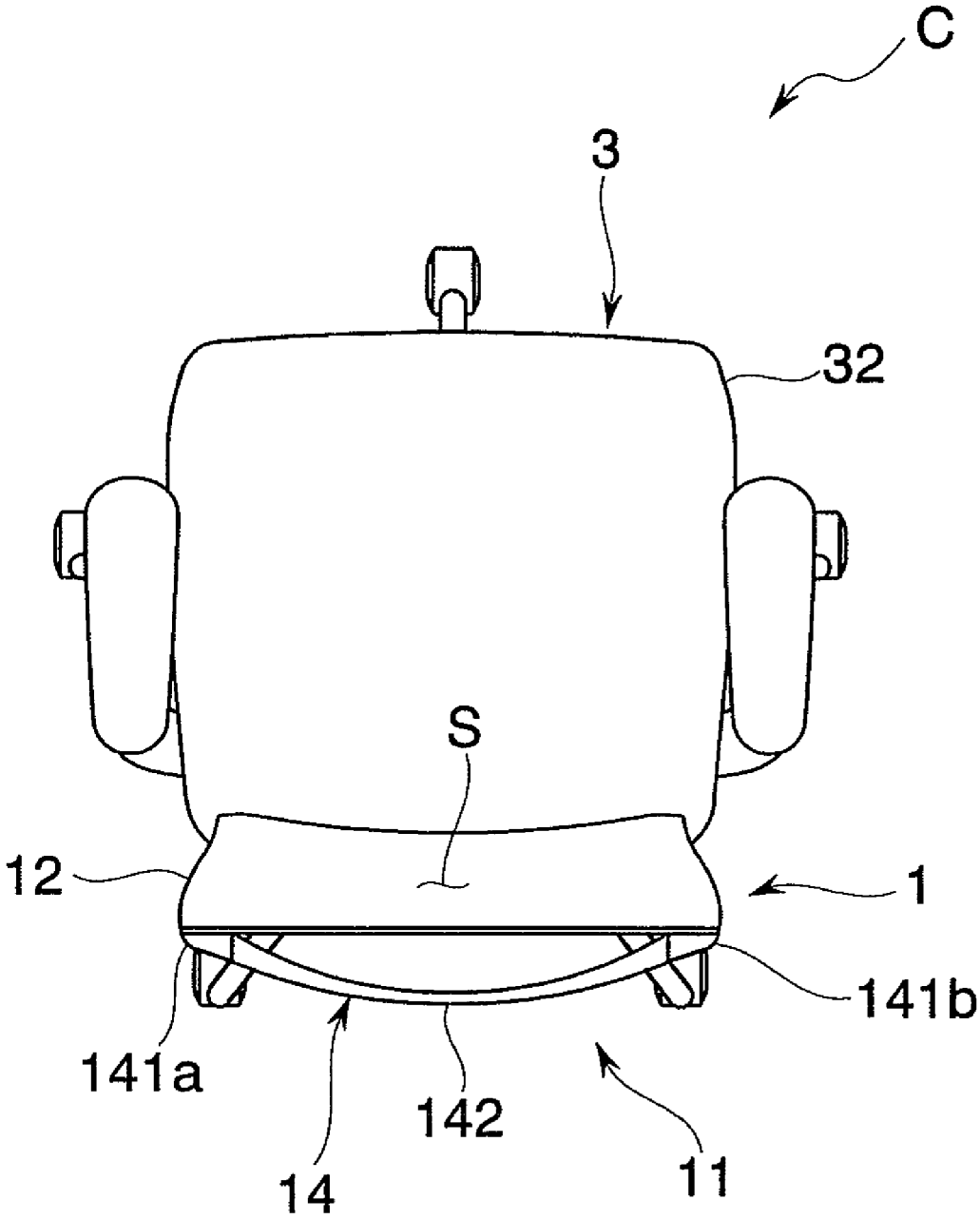
FIG. 5 is a plan view of the chair according to the embodiment.

Hereinafter, the embodiment of the present invention will be described with reference to the accompanying drawings.

A chair of this embodiment, as shown in FIGS. 1 to 5, comprises a leg body 4, a base body 2 supported by the leg body 4, a seat 3 disposed on the base body 2 and a backrest 1 pivoted to the base body 2 through a horizontal support shaft 16 and can achieve synchronous rocking motion in which the seat 3 and the backrest 1 tilt interlockingly.

If speaking in detail, the leg body 4 comprises leg wing 41 having a plurality of casters and a leg support pillar 42 standing substantially perpendicularly from the center of the leg wing 41. The leg support pillar 42 can be projected or recessed vertically by expansion and contraction of a gas spring (not shown) provided between the leg wing 41 and the leg support pillar 42.

The base body 2 is fixed to the top end of the leg support pillar 42 and the heights of the seat 3 and the backrest 1 can be adjusted through projection and recession operation of the leg support pillar 42. The base body 2 accommodates an elastic urging mechanism (not shown) which rotates around the horizontal support shaft 16 to urge the backrest 1 forward, a fixing mechanism (not shown) for fixing the rocking angle of the backrest 1 and the like. The elastic urging mechanism urges the seat back 11 elastically by means of a coil spring or a gas spring. The fixing mechanism, for example, fixes a rocking angle by selectively engaging a pawl with plural stages of recesses provided on the side of the back frame 11. If the elastic urging mechanism uses a push lock type gas spring, the expansion and contraction action of the gas spring can be prohibited by driving its valve.

The seat 3 is constructed by mounting a cushion body 32 which constitutes a seat face on a seat receiver 31. The cushion body 32, for example, has a double structure in which urethane materials are overlaid on double raschel mesh of synthetic resin, so that its lower layer mesh absorbs a shock while maintaining an appropriate elasticity and the urethane cushion material on the upper layer holds stability of its shape. The front end portion of the seat 3 is supported slidably in the back and forth direction relative to the base body 2 and the rear end portion of the seat 3 is mounted to a lower frame portion 13 of the back frame 11 through a hinge (not shown).

The backrest 1 is provided by stretching an upholstery member 12 which constitutes a backrest face S on the front face of a back frame 11. The back frame 11 comprises a lower frame portion 13 connected to the base body 2 rotatably around the horizontal support shaft 16, an upper frame portion 14 connected to the top end of the lower frame portion 13 through a hinge 17 and a reaction force frame portion 15 which supports the upper frame portion 14 from behind.

The lower frame portion 13 is constituted by connecting right and left lower frame elements 131*a*, 131*b* spaced in the width direction with each other with a rigid lateral bridging member 132. The lower frame elements 131*a*, 131*b* and the rigid lateral bridging member 132 are rigid bodies of metal. The lower frame elements 131*a*, 131*b* extend backward from a front end in which a horizontal support shaft 16 is located and bends upward at its rear end, thereby forming a substantially L shape as viewed from the side.

The upper frame portion 19 is constituted by connecting right and left upper frame elements 141*a*, 141*b* spaced in the width direction with each other with an elastic lateral bridging member 142. Although the upper frame elements 141*a*, 141*b* are rigid bodies of for example metal, the elastic lateral bridging member 142 is an elastic body of for example, resin. The upper frame elements 141*a*, 141*b* extend upward while curved mildly such as they are recessed backward to some extent from the bottom end in which the hinge 17 viewed from the side is located so as to be made into an arch swelled forward again in the vicinity of its upper end, viewed from the side.

The reaction force frame portion 15 is comprised of the same number of reaction force frame elements 151*a*, 151*b* for supporting the upper frame elements 141*a*, 141*b* as the number thereof.

According to this embodiment, the reaction force elements 151*a*, 151*b* are connected to the lower frame elements 131*a*, 131*b* which are the first members and the upper frame elements 141*a*, 141*b* which are the second members at their end portions and other end portions thereby serving as a spring member capable of accumulating reaction force by elastic deformation and the reaction force frame elements 151*a*, 151*b* are formed into frame shape extending along the upper frame elements 141*a*, 141*b* and the lower frame elements 131*a*, 131*b*.

More specifically, lower end portions 152*a*, 152*b* which are end portions of the reaction force frame elements 151*a*, 151*b* are connected to the rear face of the lower frame elements 131*a*, 131*b* and upper end portions 153*a*, 153*b* which are the other end portions thereof are connected to downward directed faces of the upper frame elements 141*a*, 141*b*. The reaction force frame elements 151*a* ,151*b* are of elastic body made of resin having the same quality as the elastic lateral bridging member 132. According to this embodiment, the reaction force frame elements 151*a*, 151*b* are resin springs having a substantially L-shaped frame configuration extending along the lower frame elements 131*a*, 131*b* and upper frame elements 141*a*, 141*b* as viewed from the side and a width dimension thereof is substantially equal to or smaller than the frame elements 131*a*, 131*b*, 141*a*, 141*b* and a thickness thereof in the back and forth direction and in the vertical direction is smaller than the frame elements 131*a*, 131*b*, 141*a*, 141*b* (if speaking additionally, the thickness decreases gradually as it goes far from end portion coupled with the frame elements 131*a*, 131*b*, 141*a*, 141*b*). Consequently, an appearance as if the reaction force frame elements 151*a*, 151*b* are part of the back frame 11 branched from the frame elements 131*a*, 131*b*, 141*a*, 141*b* is built up.

The front face of the frame as viewed from the side is expanded forward into a curved shape around the hinge 17 to which the lower frame elements 131*a*, 131*b* and the upper frame elements 141*a*, 141*b* are pivoted, more specifically in a range from the rear ends to near the top ends of the lower frame elements 131*a*, 131*b* and near the bottom ends of the upper frame elements 141*a*, 141*b*. As described previously, in portions near the top ends of the upper frame elements 141*a*, 141*b* also, the front face of the frame as viewed from the side is expanded forward into a curved shape. The upholstery member 12 is stretched over the portion formed in the curved shape of the lower frame elements 131*a*, 131*b* and the upper frame elements 141*a*, 141*b*.

The upholstery member 12 is composed of mainly upholstery material having a high stretching property. The upholstery material is produced by knitting elastic strings such as elastomer string into for example, double raschel mesh of synthetic resin and has both strength and cushion property. The upholstery material looks different between its front and rear sides (color, pattern, gloss and the like). The top side and right and left sides of the upholstery material are held into a predetermined shape by a backup member (not shown) which constitutes a three-way frame or four-way frame as viewed from the front. The backup material is a thin plate made of for example resin, which prevents particularly the right and left sides of the upholstery material from being distorted inwardly, thereby maintaining the upholstery material in a stretched state. The top end portion of the upholstery member 12 is mounted on the right and left upper frame elements 141*a*, 141*b* and the bottom end portion thereof is mounted on the right and left lower frame elements 131*a*, 131*b*. At this time, the backup member serves the operation of a leaf spring to press the upholstery material forward so that it is stretched.

It is permissible to mount a lumber support belt 18 in the back of the upholstery member 12 or at a position of height corresponding to the waist portion of a seated person. Even if the seated person applies his or her body to the backrest face S, a portion behind which the lumber support belt 18 is mounted is never sunk backward more than a depth corresponding to the length of the lumber support belt 18.

Figure 6:
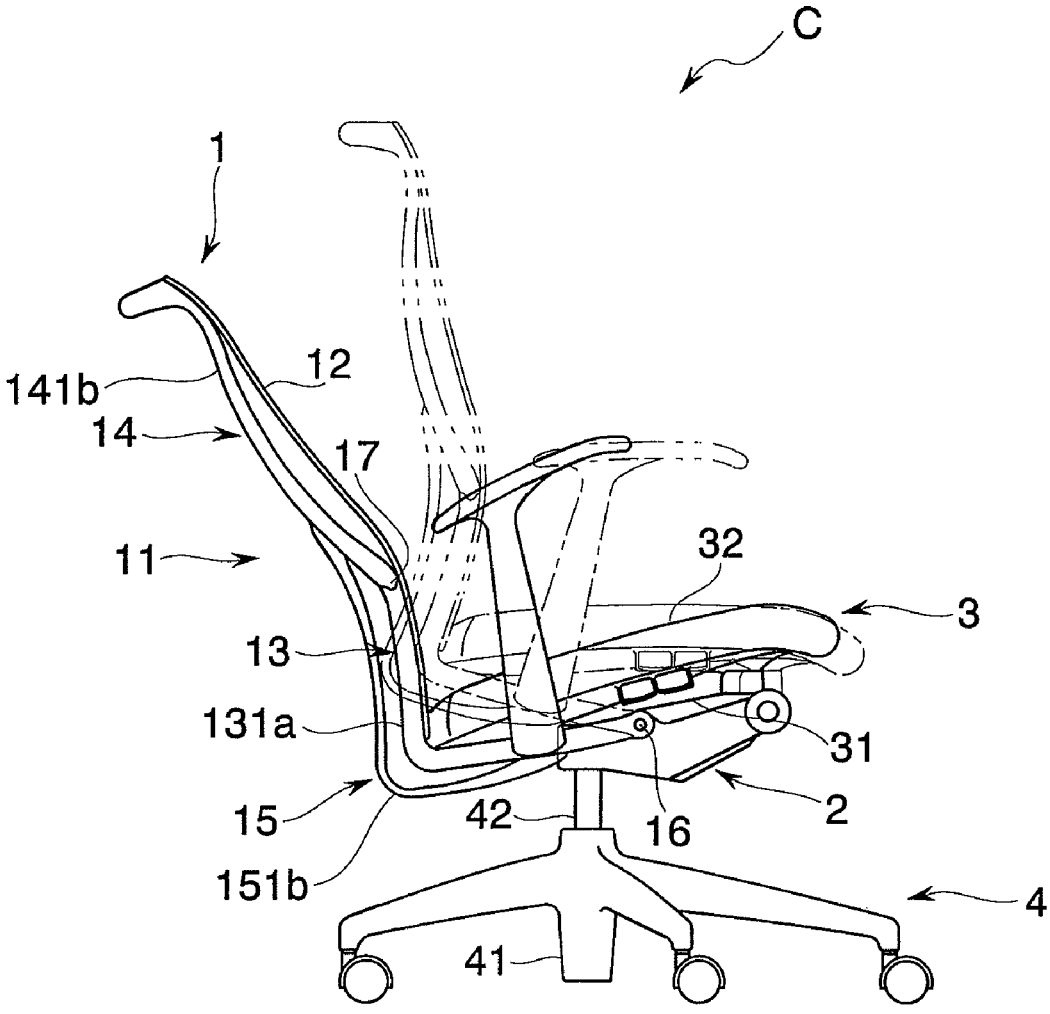
FIG. 6 is a side view showing synchronous rocking motion of the chair of the embodiment.

The chair of this embodiment can achieve synchronous rocking motion in which the seat 3 and backrest 1 tilt interlockingly. In the synchronous rocking motion, as shown in FIG. 6, the backrest 1 tilts forward and backward when the entire back frame 11 rotates around the horizontal support shaft 16. At the same time, the rear end portion of the seat 3 swings up and down interlocking with the back frame 11 and the front end portion of the seat 3 slides forward and backward.

Additionally, in the chair of this embodiment, only the left half portion or only the right half portion of the top portion of the backrest face S can be displaced backward following up the movement of the seated person, for example, turning about backward, stretching the hands or twisting the body in a seated condition. In the upper frame portion 14 which supports the top portion of the backrest face S, the upper frame elements 141*a*, 141*b* which makes a pair on the right and left move forward and backward independently. That is, the upper frame element 141*a* on the left side is connected to the lower frame element 131*a* on the left side via the hinge 17 and the upper frame element 141*b* on the right side is connected to the lower frame element 131*b* on the right side via the hinge 17, so that the upper frame elements 141*a*, 141*b* can rotate independently.

Figure 7:
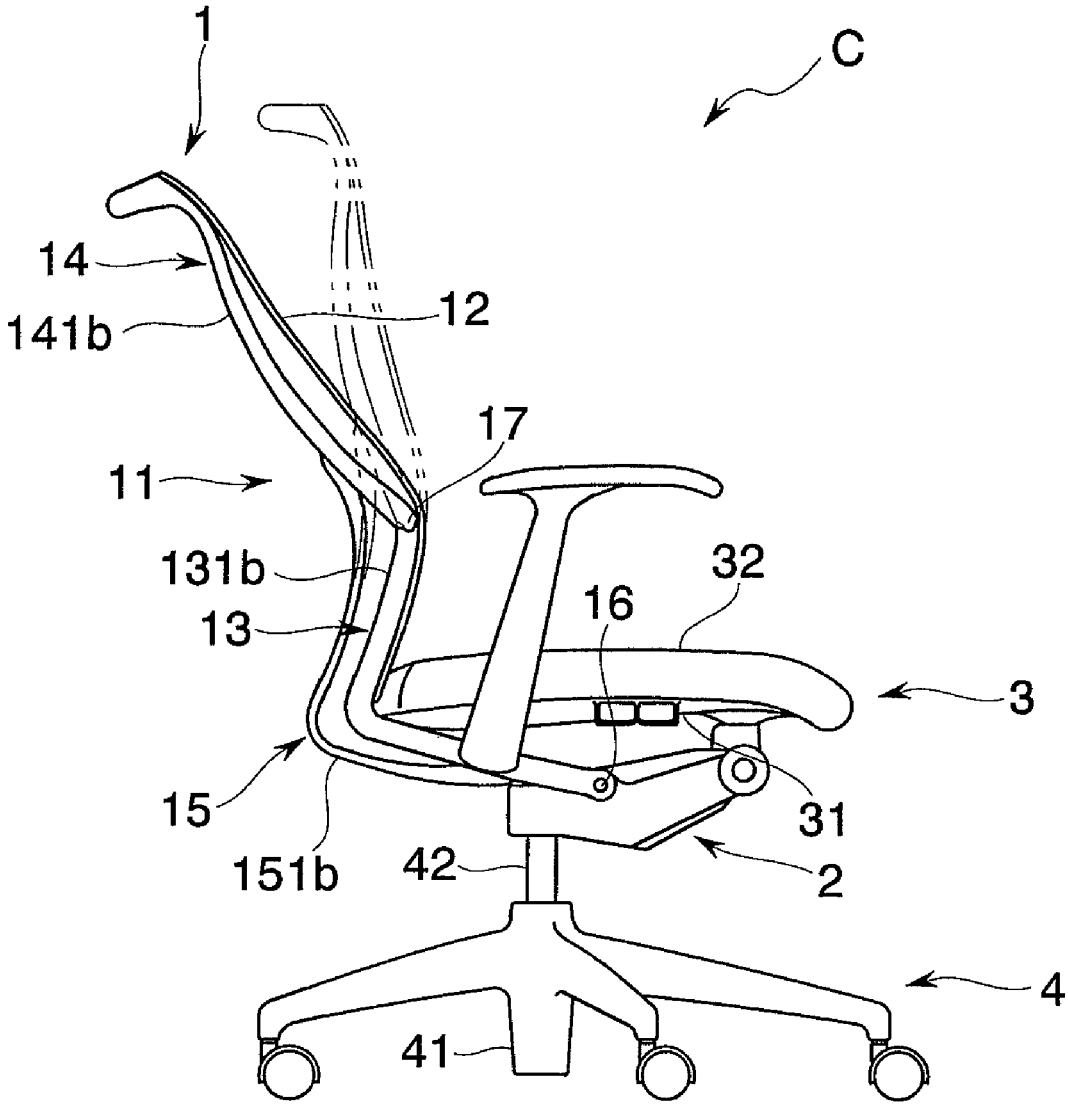
FIG. 7 is a side view showing a condition in which upper frame elements of the chair of the embodiment are displaced backward.

When the upper frame elements 141*a*, 141*b* are tilted backward around the hinge 17 as shown in FIG. 7, an area in which the upholstery member 12 comes into a contact with the curved portions of the lower frame elements 131*a*, 131*b* and the upper frame elements 141*a*, 141*b* increases gradually and the upholstery material is stretched vertically with its tension increased. In parallel, the reaction force frame elements 151*a*, 151*b* are deformed to expand its angle thereby accumulating the reaction force so as to urge the upper frame elements 141*a*, 141*b* elastically in a direction of restoring to its original position or forward.

Figure 8:
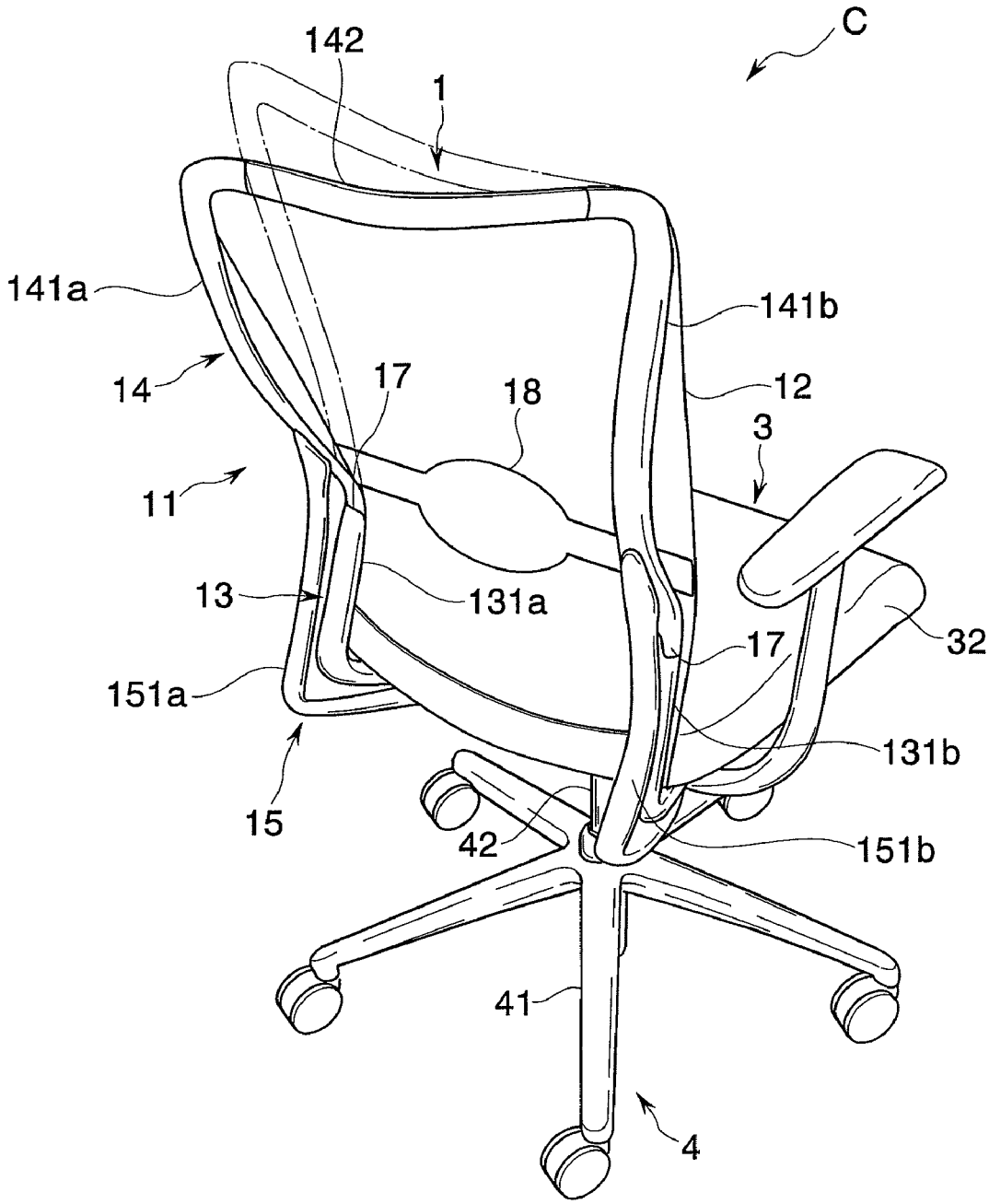
FIG. 8 is a perspective view showing deformation motion of a backrest of the chair of the embodiment.
Figure 9:
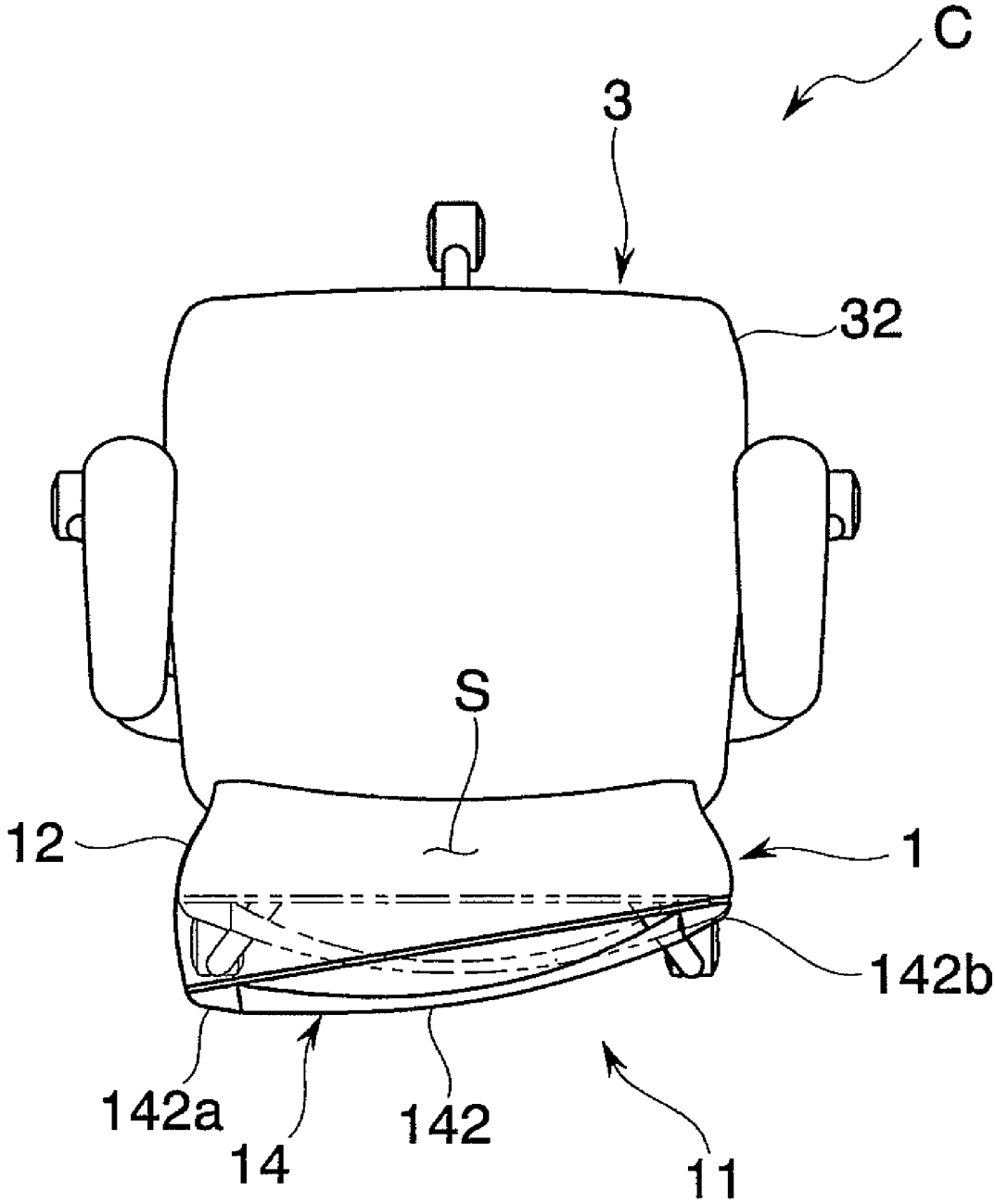
FIG. 9 is a plan view showing deformation motion of a backrest of the chair of the embodiment.

If the upper frame element 141*a* (141*b*) on any side is displaced forward and backward relative to the other upper frame element 141*b* (141*a*), the shape of the backrest face S can be changed three-dimensionally as shown in FIGS. 8, 9. In this operation, the lower frame portion 13 is not always driven. Further, because the lower frame elements 131*a*, 131*b* which make a pair on the right and left are coupled rigidly via the rigid lateral bridging member 132, those lower frame elements 131*a*, 131*b* always operate integrally. For the reason, the bottom portion of the backrest face S, that is, a portion corresponding to below the waist portion of the seated person always maintains a constant shape.

If one of the upper frame elements 141*a*, 141*b* moves in the back and forth direction relative to the other accompanied by movement of the seated person, a distance between the upper frame elements 141*a* and 141*b* on the right and left increases. At this time, the elastic lateral bridging member 142 is deformed elastically corresponding to an increase in the departing distance between the upper frame elements 141*a* and 141*b*. In the elastic lateral bridging member 142 of this embodiment, the top end portions of the upper frame elements 141*a*, 141*b* are coupled with each other so that they are assembled into a curved shape which is dented backward as viewed on the plan. The thickness in the back and forth direction of the elastic lateral bridging member 142 decreases gradually as it goes toward the center in the width direction from both end portions coupled with the upper frame elements 141*a*, 141*b* and the central portion is easier to deform than the both end portions. This is to avoid concentration of load upon a joint portion between the upper frame elements 141*a*, 141*b* and the elastic lateral bridging members 142. When one of the upper frame elements 141*a*, 141*b* moves in the back and forth direction relative to the other one, the elastic lateral bridging member 142 is deformed to reduce its curvature so as to expand the distance between both the ends.

Load of the seated person applied to the backrest face S is applied to the upper frame elements 141*a*, 141*b* via the upholstery member 12 so that it is applied to the hinge 17 to force the upper frame elements 141*a*, 141*b* down inwardly. To eliminate or reduce such a load, the elastic lateral bridging member 142 is assembled in a condition for exerting an initial elastic force so as to bring the upper frame elements 141*a*, 141*b* to opposite sides in the width direction.

The upper frame elements 141*a*, 141*b* on both the right and left sides can be tilted at the same time. In this case, the seated person can stretch his or her body such that he or she warps his or her back largely.

Because according to this embodiment, the frame elements 141*a*, 141*b* can be moved in the back and forth direction independently in the chair provided with the backrest 1 whose top portion is supported by the frame elements 141*a*, 141*b* spaced in the width direction, only the left half portion or right half portion of the top portion of the backrest face S can be displaced backward. Then, the shape of the backrest face S can be changed three-dimensionally following up a movement of the seated person such as turning back and consequently, a chair providing an excellent comfort when seated by supporting his or her body preferably without limiting his or her movement rigidly is achieved.

Additionally, the reaction force frame elements 151*a*, 151*b*, which support the top portion of the backrest face S and are frame-shaped spring members in which the bottom end portions 152*a*, 152*b* thereof are connected to the bottom face of the lower frame elements 131*a*, 131*b* while top end portions 153*a*, 153*b* thereof are connected to the rear face of the upper frame elements 141*a*, 141*b* in order to accumulate a reaction force by elastic deformation, are provided and the frame elements 141*a*, 141*b* are supported from behind by the reaction force elements 151*a*, 151*b*. Consequently, there is no necessity of installing a coil spring or the like at the portion including the hinge 17 thereby not expanding the construction around the hinge 17. At the same time, because the reaction force frames 151*a*, 151*b* are constructed in a shape extending along the lower frame elements 131*a*, 131*b* and the upper frame elements 141*a*, 141*b*, the appearance of the reaction force frame elements 151*a*, 151*b* can be made to look as part of the back frame 11 thereby providing existence of the reaction force frame elements 151*a*, 151*b* without disharmony and further maintaining beautiful and elegant appearances as a furniture.

The plural upper frame elements 141*a*, 141*b* for supporting the top portion of the backrest S can be displaced in the back and forth direction individually without displacing the lower frame elements 131*a*, 131*b* which support the bottom portion of the backrest S and thus, when the seated person turns back or does other action, the seat back S fits to his or her natural body shape thereby unlikely applying an additional load to him or her.

Because the upper frame elements 141*a*, 141*b* are connected to the lower frame elements 131*a*, 131*b* through the hinge 17 so that the upper frame elements 141*a*, 141*b* can be tilted backward relative to the lower frame elements 131*a*, 131*b*, it is possible to select a rocking action of tilting the entire backrest S integrally or backrest deformation action of tilting only the top portion of the backrest face S. Of course, the rocking action and backrest deformation action can be induced simultaneously so that the seated person can take various postures when seated.

A movement of the upper frame elements 141*a*, 141*b* which support the top portion of the backrest face S when receiving a load of the seated person indirectly through the backrest face S is met by mutually connecting the upper frame elements 141*a*, 141*b* with the lateral bridging member 142 elastically deformable.

Further, because the lateral bridging member 142 is installed in a condition which allows it to exert its initial elastic force of bringing the upper frame elements 141*a*, 141*b* away from each other in a width direction when a load is applied to the backrest face S thereby forcing the upper frame elements 141*a*, 141*b* down inwardly, the load applied to the upper frame elements 141*a*, 141*b* and the hinge 17 can be reduced.

As the seated person moves his or her body, one of the upper frame elements 141*a*, 141*b* is displaced relative to the other thereby increasing a distance between the frame upper elements 141*a* and 141*b*. Thus, the lateral bridging member 142 is installed in a condition in which it is curved when it is viewed on the plan, so that the upper frame elements 141*a*, 141*b* are deformed to decrease the curvature when one of them moves in the back and forth direction relative to the other in order to meet an increase of the distance between the upper frame elements 141*a* and 141*b*.

Because the backrest face S is constructed by stretching the upholstery member 12 elastically deformable over the front face of the plural upper frame elements 141*a*, 141*b*, the backrest face S is deformed following up various movements of the seated person, fitting to a wide range of his or her body thereby providing a feeling of softness with little burden.

In the meantime, the present invention is not restricted to the above-described embodiments.

Figure 10:
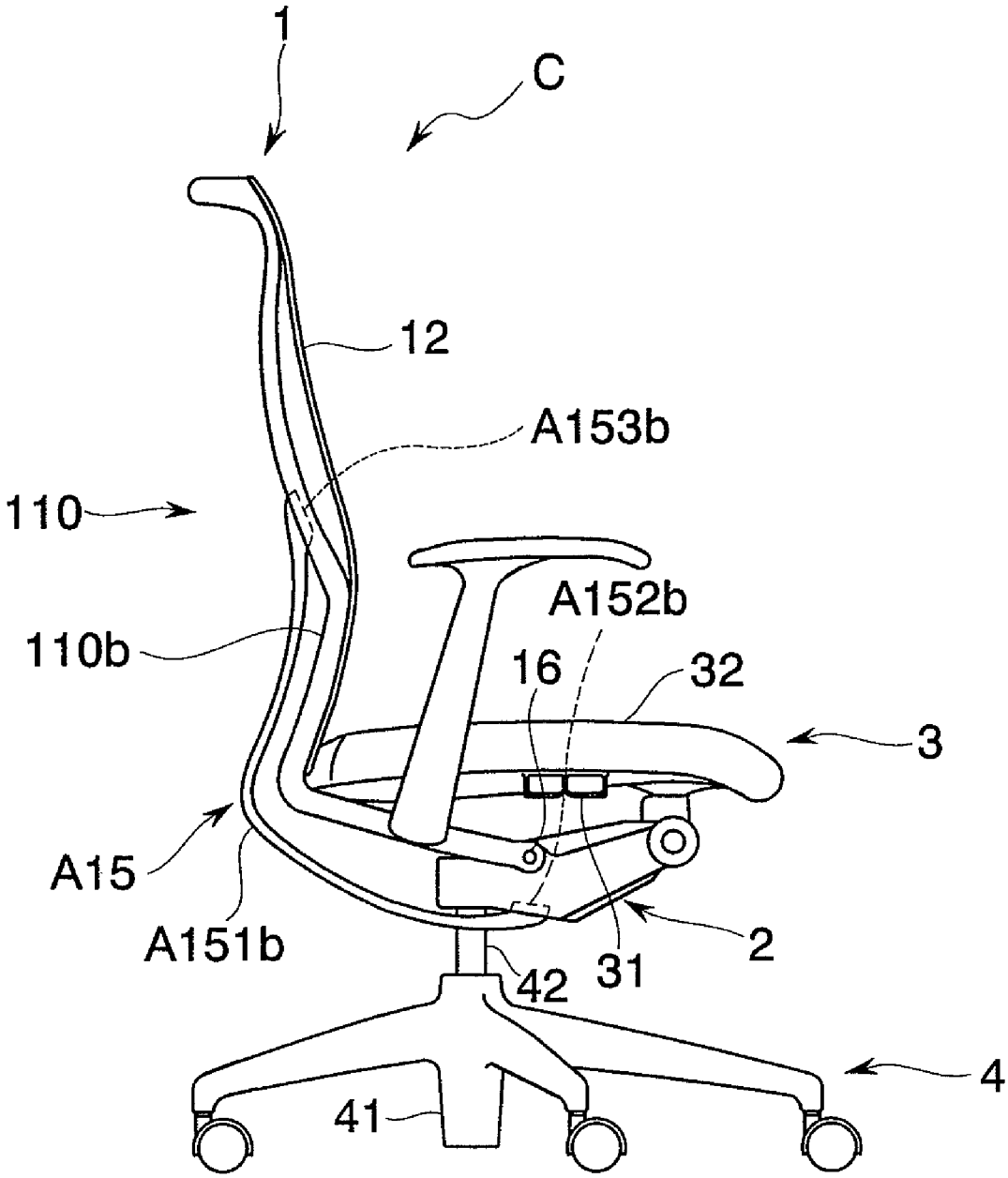
FIG. 10 is a side view of the chair of other embodiment of the present invention.

For example, in a chair having a back frame 110 comprising rear frame elements 110*a*, 110*b*, right and left spaced in the width direction and an elastic lateral bridging member (not shown) which connects top end portions of the right, left rear frame elements 110*a*, 110*b* as shown with a right side view in FIG. 10, a following structure may be adopted instead of the back frame 11 of the chair C described above. That is, a structure having reaction force frame elements 151*a*, 151*b* provided on the right and left in pair which serve as frame-shape spring members in which an end portion and the other portion thereof are connected to the first and second members respectively so as to accumulate a reaction force by their elastic deformations, the reaction force frame elements extending along the first and second members may be adopted, in which the first member is the base body 2 which supports the seat 3 and backrest 1 of the chair and the second member is right, left rear frame elements 110*a*, 110*b* extending throughout the height of the backrest 1 of the chair.

The right, left rear frame elements 110*a*, 110*b* extend backward from the front end in which the horizontal support shaft 16 is located thereby providing a substantially letter L shape on its side view in which it is bent upward. Further, the right, left rear frame elements 110*a*, 110*b* are of rigid body of metal while the elastic lateral bridging member is of elastic body of resin.

The right, left reaction force frame elements A151*a*, A151*b* support the right, left rear frame elements 110*a*, 110*b* and utilize the elastic body made of resin to constitute a reaction force frame portion A15. These right, left reaction force frame elements A151*a*, A151*b* are connected to the rear face of the base body 2 at their bottom end portions A152*a*, A152*b* and the top end portions A153*a*, A153*b* thereof are connected to the rear face of the rear frame elements 110*a*, 110*b*.

When the rear frame elements 110*a*, 110*b* are tilted backward around the horizontal supporting shaft 16, the reaction force frame elements A151*a*, A151*b* are deformed so as to expand their angles accumulating a reaction force to elastically urge the rear frame elements 110*a*, 110*b* in a direction of restoring to their original position, that is, forward.

That is, because with such a structure, as the backrest 1 is tilted backward largely relative to the base body 2, a large reaction force can be accumulated in the reaction force frame portion A15, more specifically, in the reaction force frame elements A151*a*, A151*b*, an effect of increasing a reaction force applied to the backrest 1 as the backrest 1 is tilted backward largely can be obtained effectively and easily.

Figure 11:
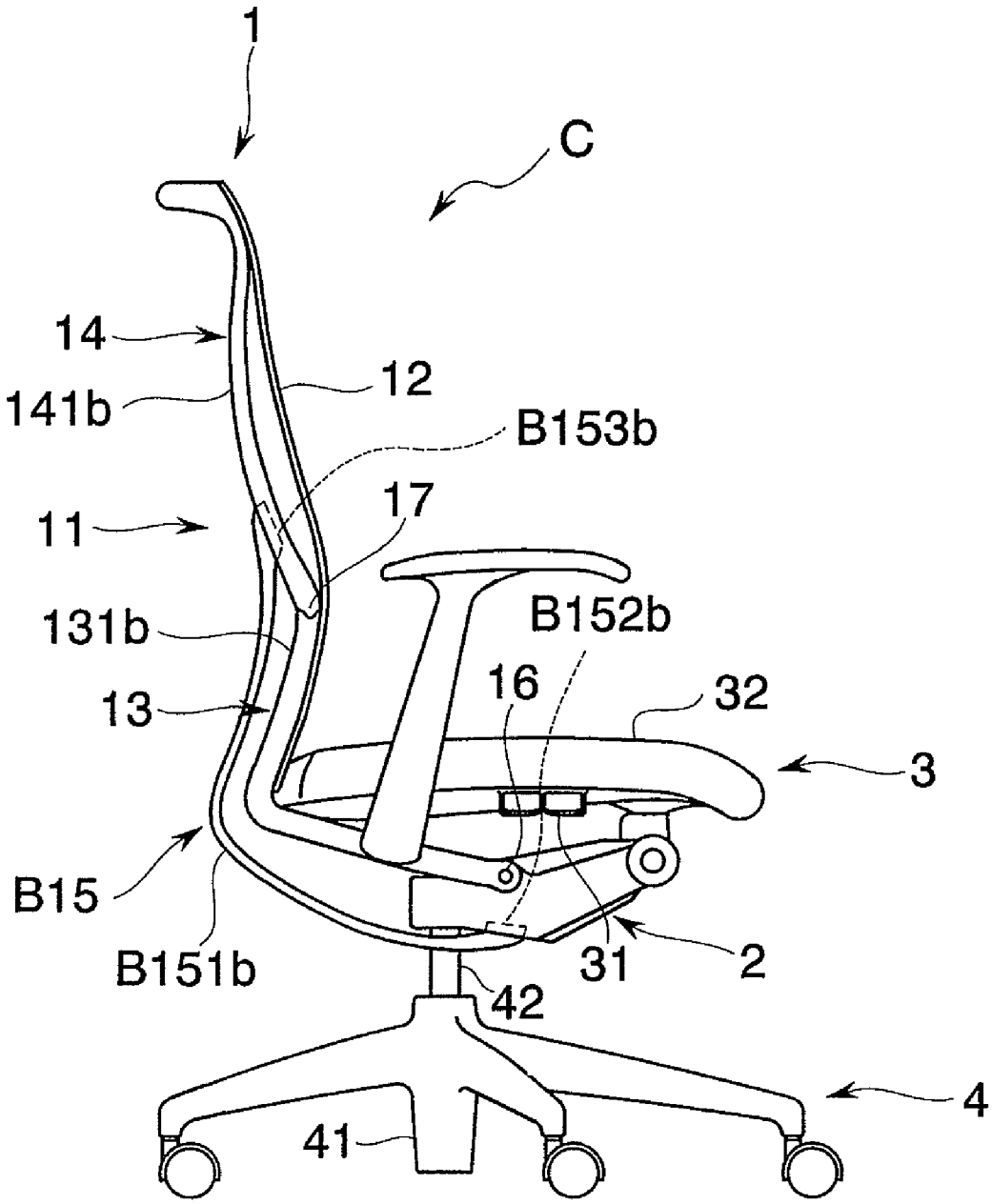
FIG. 11 is a side view of the chair of other embodiment of the present invention.

Additionally, in the above-described embodiment, a structure having a reaction force frame portion B15 comprising frame-shaped reaction force frame elements B151*a*, B151*b*, right and left in pair in which an end portion, more specifically, bottom end portions B152*a*, B152*b* are connected to the base body 2 as a first member while the other end portion, more specifically, top end portions B153*a*, B153*b* are connected to the upper frame elements 141*a*, 141*b* as a second member as shown with a right side view in FIG. 11 so as to accumulate a reaction force by their elastic deformation as the spring member, the reaction force frame elements extending along the first and second members, may be adopted.

Figure 12:
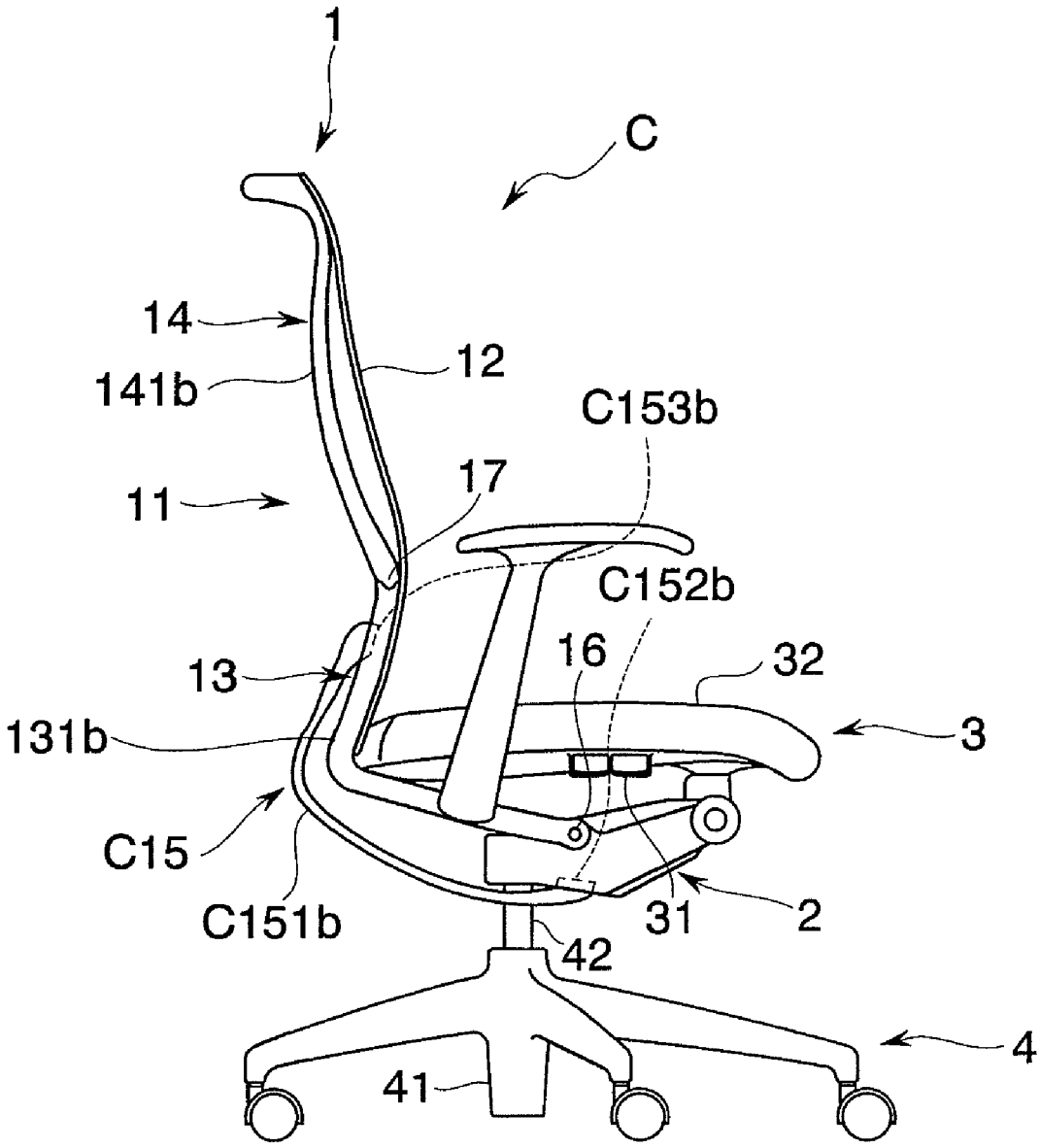
FIG. 12 is a side view of the chair of other embodiment of the present invention.

Further, in the above-described embodiment, a structure having a reaction force frame portion B15 comprising frame-shaped reaction force frame elements C151*a*, C151*b*, right and left in pair in which an end portion, more specifically, bottom end portions C152*a*, C152*b* are connected to the base body 2 as a first member while the other end portion, more specifically, top end portions C153*a*, C153*b* are connected to the lower frame elements 131*a*, 131*b* as a second member as shown with a right side view in FIG. 12 so as to accumulate a reaction force by their elastic deformation as the spring member, the reaction force frame elements extending along the first and second members, may be adopted.

When any of the structures shown in FIGS. 11, 12 is adopted, a large reaction force can be accumulated in the reaction force frame portions B15, C15, more specifically in the reaction force frame elements B151*a*, B151*b*, C151*a*, C151*b* as the backrest 1 is tilted backward largely relative to the base body 2, an effect of increasing the reaction force applied to the backrest 1 as the backrest 1 is tilted backward largely can be obtained easily.

Figure 13:
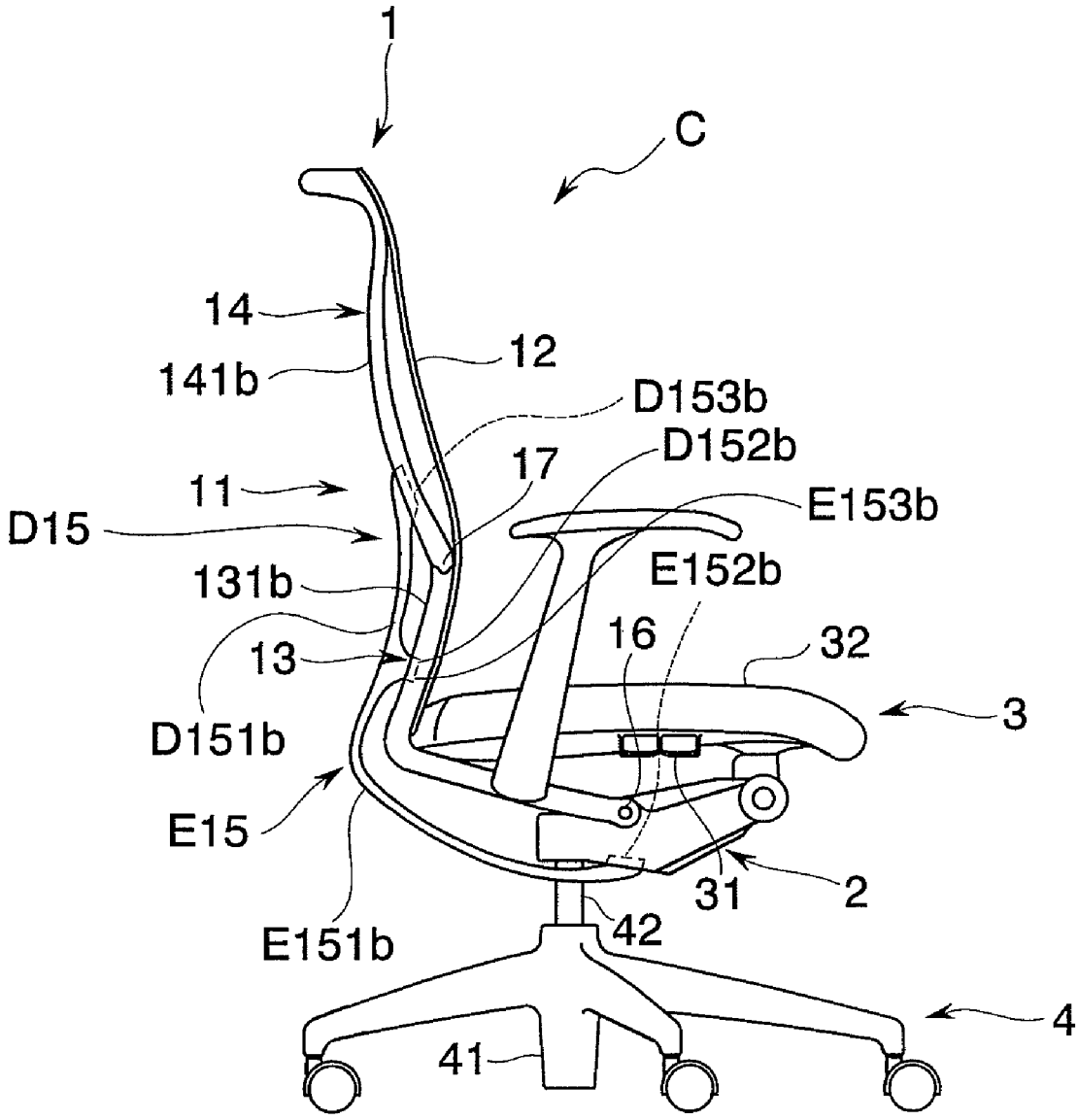
FIG. 13 is a side view of the chair of other embodiment of the present invention.

Further, first and second reaction force frames D15, E15 may be provided at the same time as shown with a right side view in FIG. 13.

In this embodiment, the first reaction force frame D15 has frame-shaped first reaction force frame elements D151*a*, D151*b* provided on the right and left in pair in which an end portion, more specifically bottom end portions D152*a*, D152*b* are connected to the lower frame elements 131*a*, 131*b* as a first member while the other end portion, more specifically, the top end portions D153*a*, D153*b* are connected to the upper frame elements 141*a*, 141*b* as a second member substantially like the reaction force frame portion 15 described in the above embodiments so as to accumulate a reaction force by their elastic deformation as the spring member, the first reaction force frame elements D151*a* , D151*b* extending along the lower frame elements 131*a*, 131*b* and the upper frame elements 141*a*, 141*b*.

On the other hand, the second reaction force frame portions E15 has frame-shaped second reaction force frame elements E151*a*, E151*b* provided on the right and left in pair in which an end portion, more specifically, bottom end portions E152*a*, E152*b* are connected to the base body 2 as a first member while the other end portion, more specifically top end portions E153*a*, E153*b* are connected to the lower frame elements 131*a*, 131*b* as a second member so as to accumulate a reaction force by their elastic deformation as the spring member, the second reaction force frames E151*a*, E151*b* extending along the upper frame elements 141*a*, 141*b* and the base body 2. Although in this embodiment, the second reaction force frame elements E151*a*, E151*b* are connected to the bottom of the first reaction force frame elements D151*a*, D151*b* integrally, the first reaction force frame elements D151*a*, D151*b* and the second reaction force frame elements E151*a*, E151*b* may be formed separately.

According to this embodiment, when the upper frame elements 141*a*, 141*b* are tilted backward around the hinge 17, the first reaction force frame elements D151*a*, D151*b* are deformed to expand the angle to accumulate the reaction force thereby urging the upper frame elements 141*a*, 141*b* in a direction of restoring to their original positions, that is, forward. When the lower frame elements 131*a*, 131*b* are tilted backward around the horizontal supporting shaft 16, the second reaction force frame elements E151*a*, E151*b* are deformed to expand the angle so as to accumulate the reaction force thereby urging the lower frame elements 131*a*, 131*b* in a direction of restoring to their original positions, that is, forward. Accordingly, when the upper portion of the back is warped and the entire backrest 1 is tilted backward, a larger reaction force can be applied as the backward tilting angle is increased. Additionally, because the first and second reaction force frame elements D151*a*, D151*b*, E151*a*, E151*b* are formed in a shape extending along the base body 2, lower frame elements 131*a*, 131*b* and upper frame elements 141*a*, 141*b*, the appearances of the first and second reaction force frame elements D151*a*, D151*b*, E151*a*, E151*b* can be made to look as part of the back frame 11, thereby providing existences of the first and second reaction force frame elements D151*a*, D151*b*, E151*a*, E151*b* with no feeling of disharmony and maintaining beautiful and elegant appearance.

Figure 14:
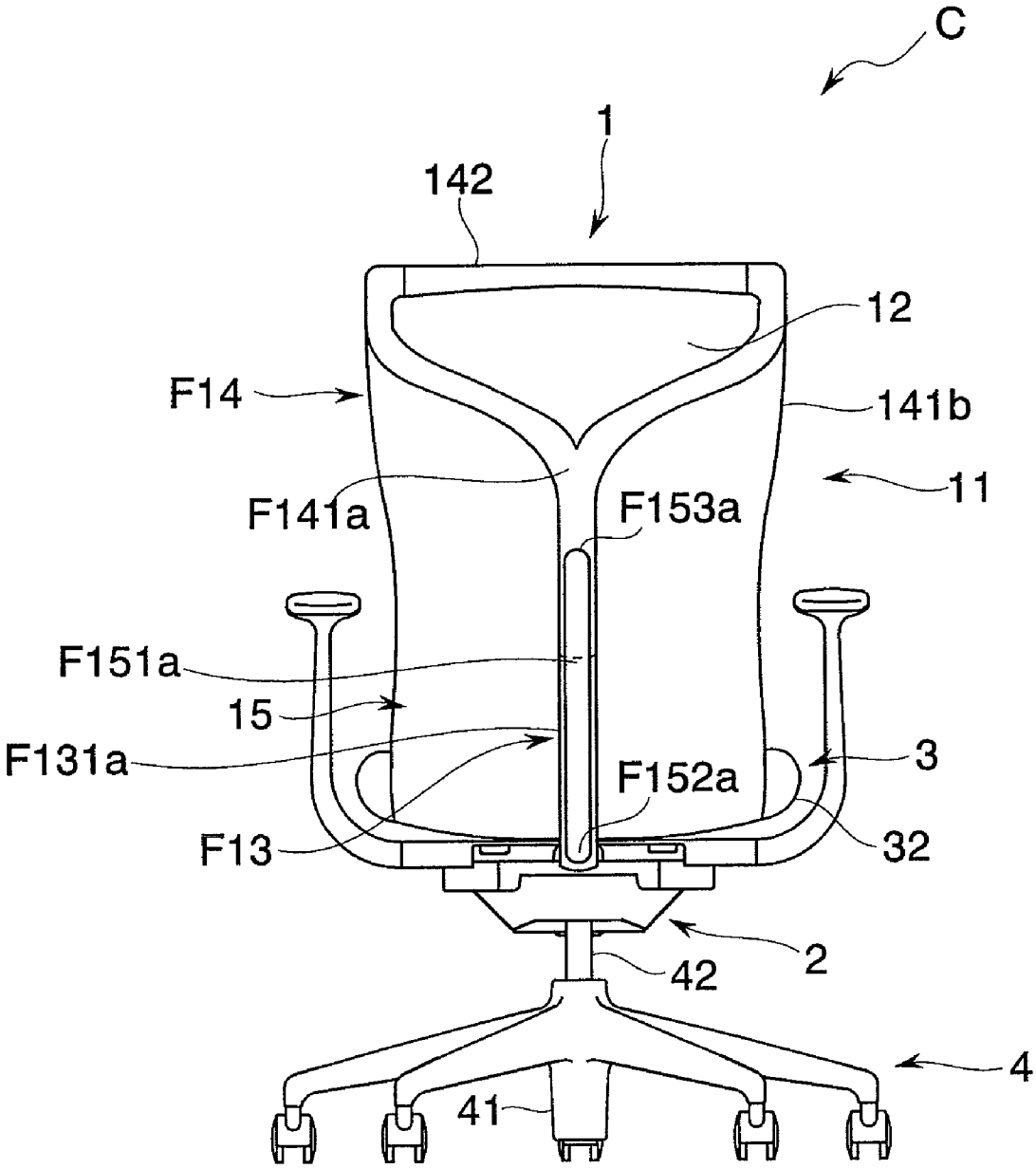
FIG. 14 is a rear view of the chair of other embodiment of the present invention.

Further, as shown in a rear view of FIG. 14, the present invention may be applied to a chair having a rear frame F11 of an embodiment in which a lower frame portion F13 is constituted of a lower frame element F131*a* of a single piece whose bottom end portion is pivoted to the base body 2 and an upper frame portion F14 is constituted of an upper frame element F141*a* which is formed in a letter Y shape, a bottom end portion thereof being pivoting to a top end portion of the lower frame element F131*a*. That is, the lower frame element 131*a* as a first member includes a reaction force frame element F151*a* as a frame-like spring member in which an end portion, more specifically bottom end portions F152*a*, Ff152*b* thereof are connected to the lower frame element F131*a* as a first member while the other end, more specifically the top end portions F153*a*, F153*b* are connected to the upper frame element F141*a* as a second member. If the reaction force frame element F151*a* is formed into a shape extending along the lower frame element F131*a* and the upper frame element F141*a*, only a shaft member needs to be provided on the hinge portion (not shown) to which the upper, lower frame elements F131*a*, F141*a* are pivoted and the appearance of this reaction force frame element F151*a* can be made to look as part of the rear frame F11, thereby maintaining a beautiful and elegant appearance as furniture. Further, the upper frame element may be formed into a letter T shape. This embodiment can be applied to a chair of an embodiment in which the upper frame portion is formed of a pair of the upper frame elements, right and left, whose bottom ends are pivoted to the lower frame elements, although not shown. If a pair of the reaction force frame elements, right and left, are provided, this embodiment allows a reaction force corresponding to a backward tilting angle of each of the right and left upper frame elements to be applied following up a seated person's movement of warping only his or her right or left back by twisting the body.

Additionally, although not shown, a chair having a structure in which the upper frame portion and lower frame portion are pivoted to the base body independently may include first and second reaction force frame elements which are frame-like spring members in which an end portion thereof is connected to the base body as a first member while the other end portion thereof is connected to the upper frame element and the second frame element as a second member and the first and second reaction force frame elements maybe formed into a shape extending along the upper frame element or the lower frame element. The above-described effect can be obtained by adopting such an embodiment also.

Figure 15:
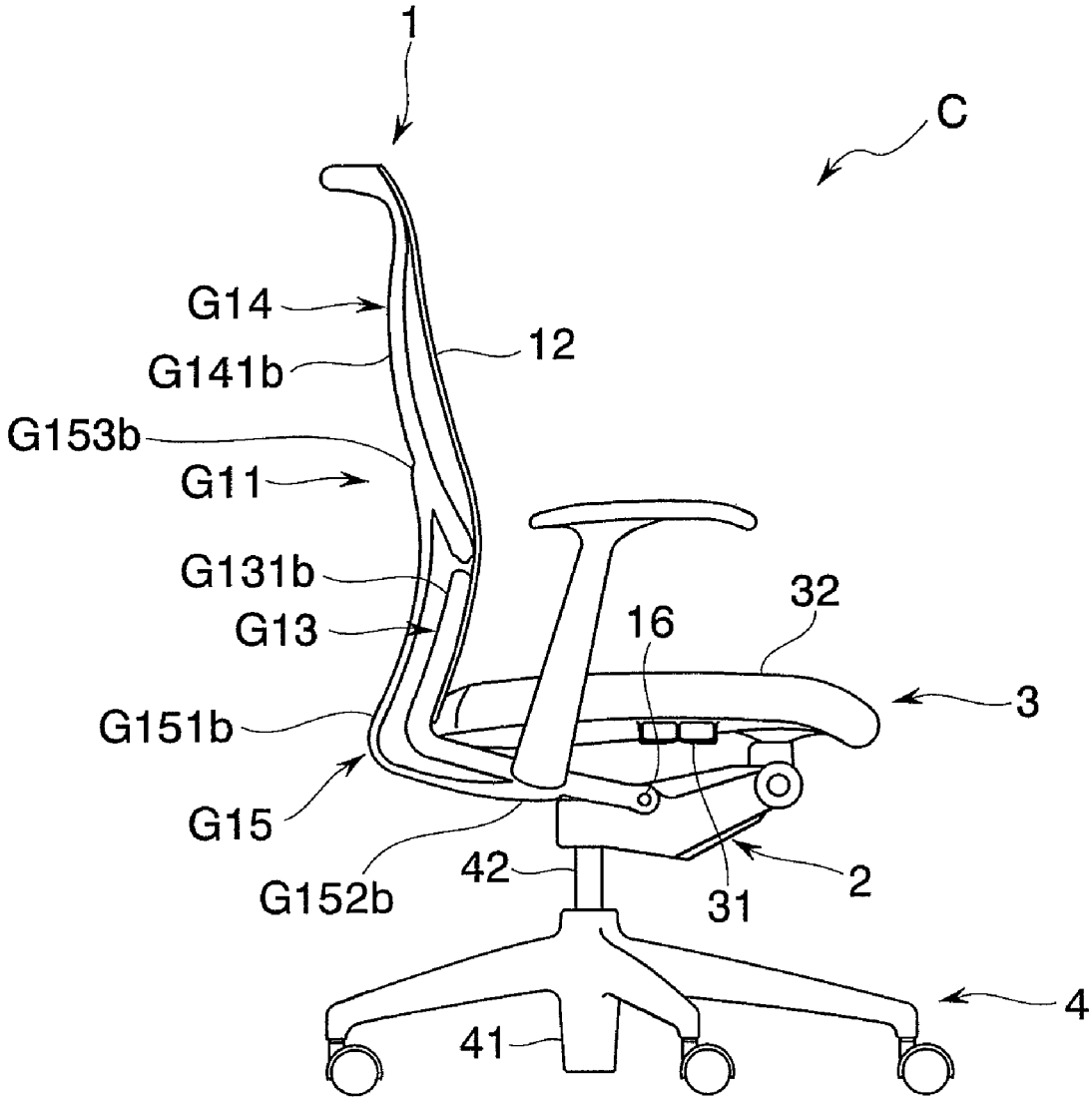
FIG. 15 is a side view of the chair of other embodiment of the present invention.

Further, as shown with a right side view in FIG. 15, lower frame elements G131*a*, G131*b* as a first member, upper frame elements G141*a*, G141*b* as a second member and reaction force frame elements G151*a*, G151*b* as a spring member may be formed integrally. More specifically, such an embodiment that a rear frame portion G11 includes a lower frame portion G13 which has at least the lower frame elements G131*a*, G131*b* provided on the right and left in pair, an upper frame portion G14 which has at least the upper frame elements G141*a*, G141*b* provided on the right and left in pair and a reaction force frame portion G15 which has the reaction force frame elements G151*a*, G151*b* provided on the right and left in pair, and the entire rear frame G11 is formed integrally, can be considered. In this case, an embodiment that the lower frame elements G131*a*, G131*b*, the upper frame elements G141*a*, G141*b* and the reaction force frame elements G151*a*, G151*b* are made of metal having elasticity and the lower frame elements G131*a*, G131*b* and the upper frame elements G141*a*, G141*b* are formed in a large thickness so as to secure stiffness while the reaction force frame elements G151*a*, G151*b* are formed in a small thickness so as to facilitate elastic deformation can be considered. More specifically, an embodiment that the rear fame G11 is formed into a shape in which the bottom end portions G151*a*, G152*b* which are end portions of the reaction force frame elements G151*a*, G151*b* are connected to the lower frame elements G131*a*, G131*b* while top end portions G153*a*, G153*b* which are other end portions of the reaction force frame elements G151*a*, G151*b* are connected to the upper frame elements G141*a*, G141*b* can be considered. Of course, it is permissible to adopt an embodiment that the first member and spring member are formed integrally while the second member is formed separately or an embodiment in which the second member and spring member are formed integrally while the first member is formed separately. Further, an embodiment including right, left rear frame elements and a lateral bridging member for connecting the right and left rear frame elements may be adopted.

Additionally, as other embodiment that the first member and the spring member are formed integrally, following embodiments can be considered.

Figure 16:
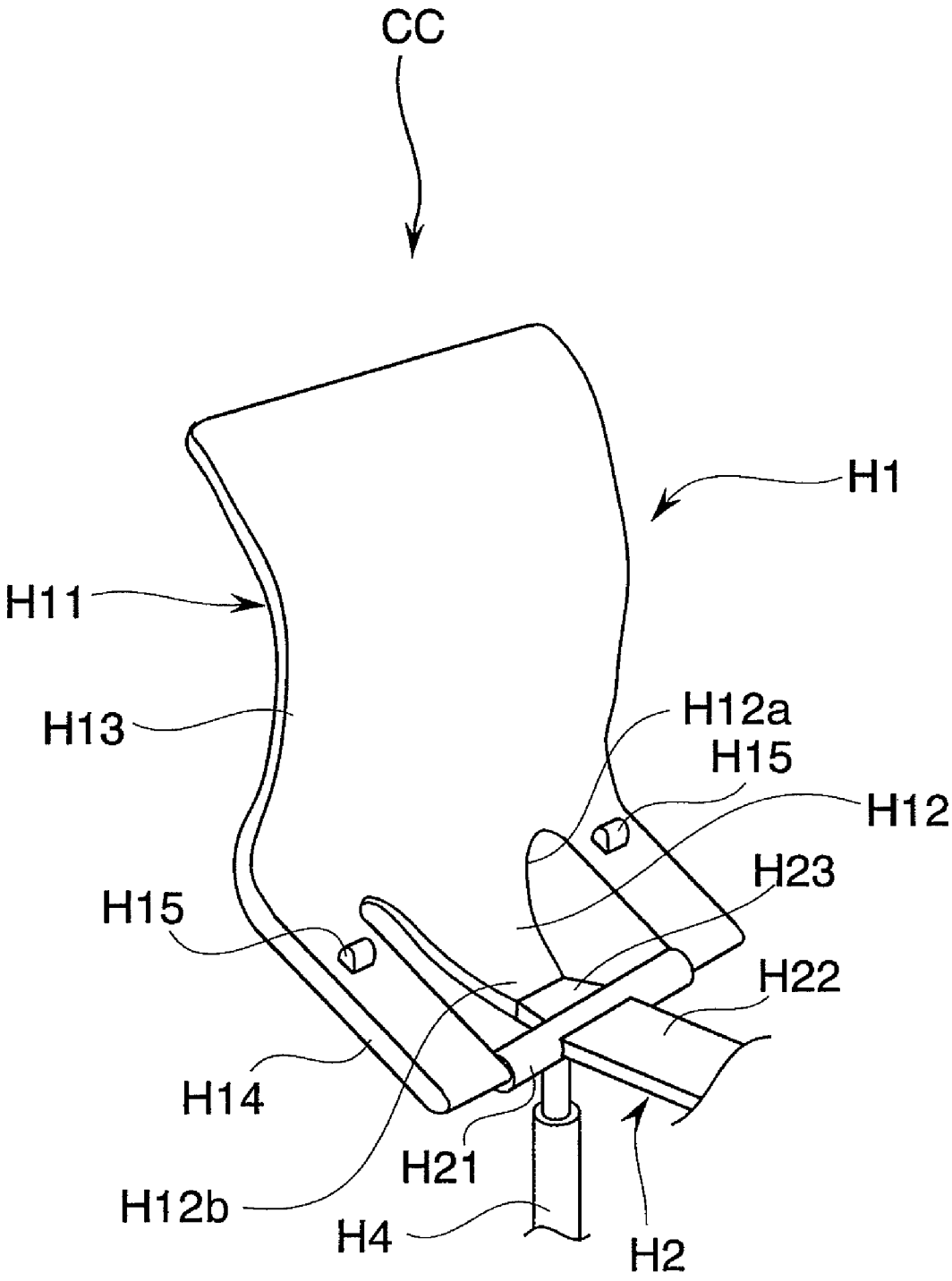
FIG. 16 is a perspective view of major portions of the chair of other embodiment of the present invention.
Figure 17:
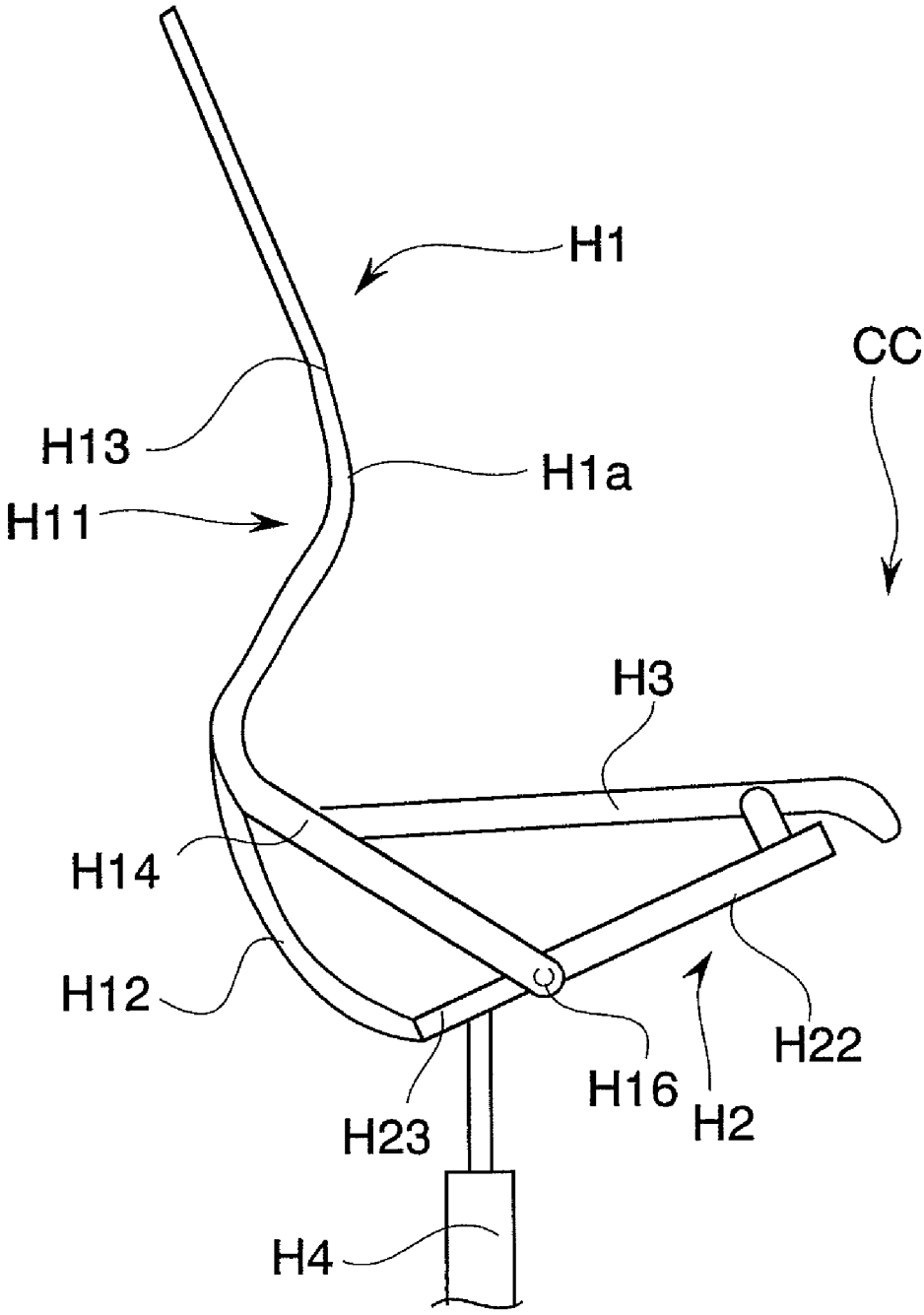
FIG. 17 is a side view of the chair of the embodiment.

A chair CC of this embodiment, as shown in FIGS. 16 and 17, comprises a leg body H4, a base body H2 supported by the leg body H4, a seat H3 disposed on the base body H2 and a seat back H1 pivoted to the base body H2 through a horizontal supporting shaft H16 and the seat H3 and the seat back H1 can execute synchronous rocking motion in which the seat H3 and the seat back H1 are tilted interlockingly.

The seat H3 and the leg body H4 have the same structure as the seat 3 and leg body 4 of the above-described embodiments.

The base body H2 is fixed to the top end of the leg body H4 and comprises a supporting shaft portion H21 which is located just above the leg body H4 and contains the horizontal supporting shaft H16 internally, a seat supporting portion H22 which extends upward forward from this supporting shaft portion H21 and is connected to a front end portion of the seat H3 at its front end portion and an acting portion H23 which extends on an extension of the seat supporting portion H22 downward and backward from the supporting shaft portion H21 and is connected to an elastic portion H12 described later of the backrest H1. In this embodiment, the supporting shaft portion H2 and the seat supporting portion H22 are pipe-like members. The acting portion H23 is a sheet-like member.

In this embodiment, the backrest H1 is a resin made shell-like member comprised of a backrest main body H11 as a first member and an elastic portion H12 as a spring member extending downward from the bottom end of a central portion in the width direction of the backrest main body 11.

The backrest main body H11 is comprised of a back portion H13 having a backrest face H11*a* and a connecting portion H14 extending downward and forward from both end portions on the right and left of the back portion H13 and connected to the horizontal supporting shaft H16 at its front end portion. A cutout portion H1*x* is provided between the connecting portion. H14 and the elastic portion H12. Then, seat mounting portions H15 for pivoting the rear end portion of the seat H3 are provided near the bottom end of the backrest main body H11, more in detail, near a border between the rear portion H13 and the connecting portion H14.

On the other hand, in the elastic portion H12, a top end portion H12*a* as an end portion on one side is connected to the back portion H13 of the backrest main body H11 integrally and a bottom end portion H12*b* as the other end portion is connected to the acting portion H23 which is a rear end portion of the base body H2 as a second member. Then, this elastic portion H12 has a shape extending along the backrest main body H11, speaking more in detail, along the connecting portion H14.

When the backrest H1 of such a chair CC is tilted backward, the rear end portion of the seat H3 is pulled by the backrest H1 so that it moves backward and downward. That is, the seat back H1 and the seat H3 carry out the rocking motion interlockingly. On the other hand, a front end of the elastic portion H12 of the backrest H1 is connected to the acting portion H23 of the base body H2 and a proximal end of the elastic portion H12 is connected to the backrest main body H11 integrally. Thus, when the elastic portion H12 is deformed elastically, a reaction force is applied to the backrest main body H11. This reaction force is intensified as the seat back H1 is tilted backward largely.

Thus, in the chair CC of this embodiment also, the elastic portion H12 is interposed between the backrest main body H11 as a first member and the base body H2 as a second member and this elastic portion H12 is formed in a shape extending along the backrest main body H11, speaking more in detail, along the connecting portion H14. Consequently, a structure which applies a reaction force to the backrest H1 as the backrest H1 is tilted backward without forming a construction near the horizontal supporting shaft H16 in which the backrest main body H11 and the base body H2 are pivoted to each other unnaturally in a large diameter can be established.

Additionally, because according to this embodiment, the backrest main body H11 and the elastic portion H12 are formed integrally and the seat H3 is connected to the seat mounting portion H15, the base body H2 does not require any coil spring for generating a reaction force or any mechanism for compressing this and consequently, a backrest synchronous rocking mechanism can be achieved with a simple structure of connecting the backrest main body H11 to the base body H2 with the horizontal supporting shaft H16.

Although in the above embodiment, the backrest H1 is constructed with only a resin made shell-shaped member, it is permissible to adopt the shell having the same structure as the backrest H1 and a backrest having back cushion provided in front of this shell. Additionally, it is permissible to adopt a backrest having an outer shell having the same structure as the backrest H1, an inner shell provided in front of this outer shell and a back cushion provided further in front of this inner shell.

Figure 18:
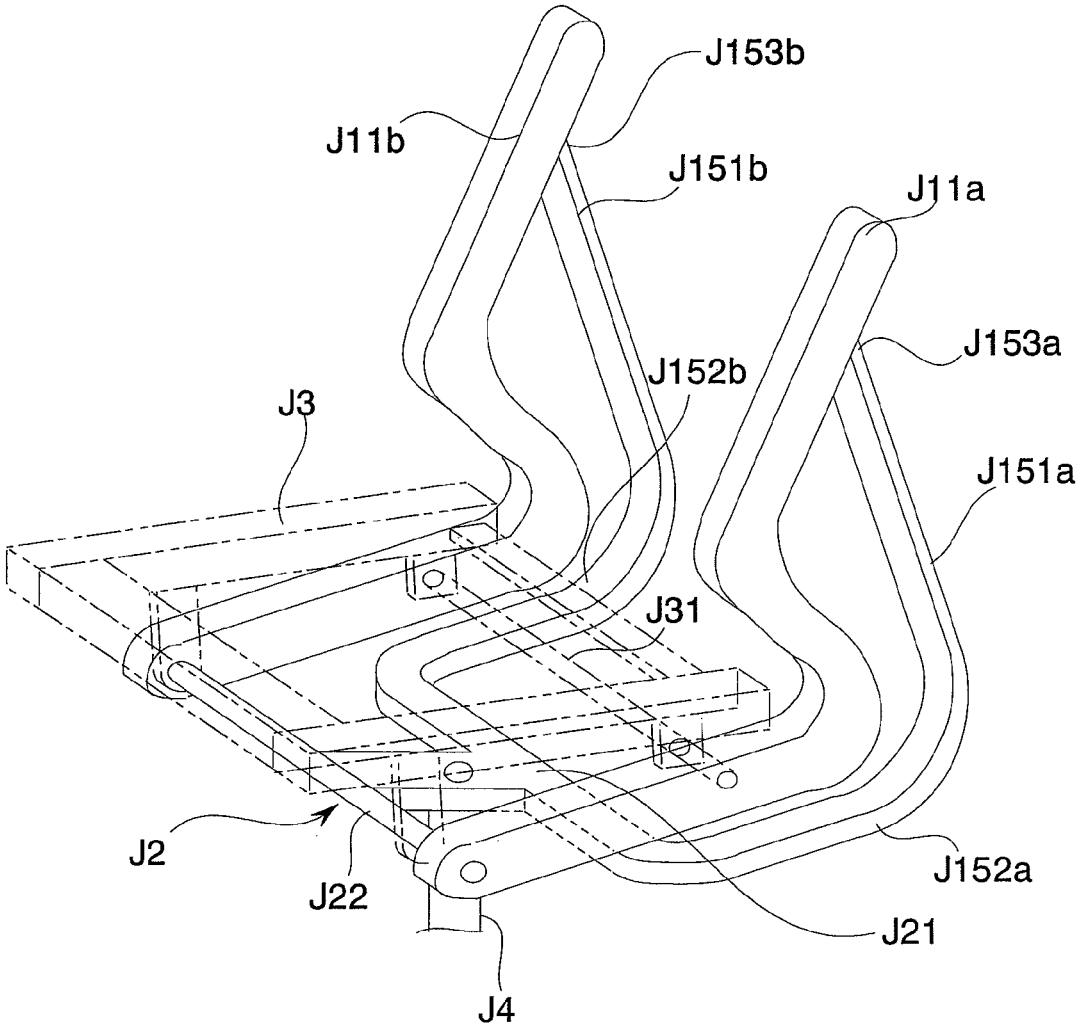
FIG. 18 is a perspective view of the frame structure according to other embodiment of the present invention.
Figure 19:
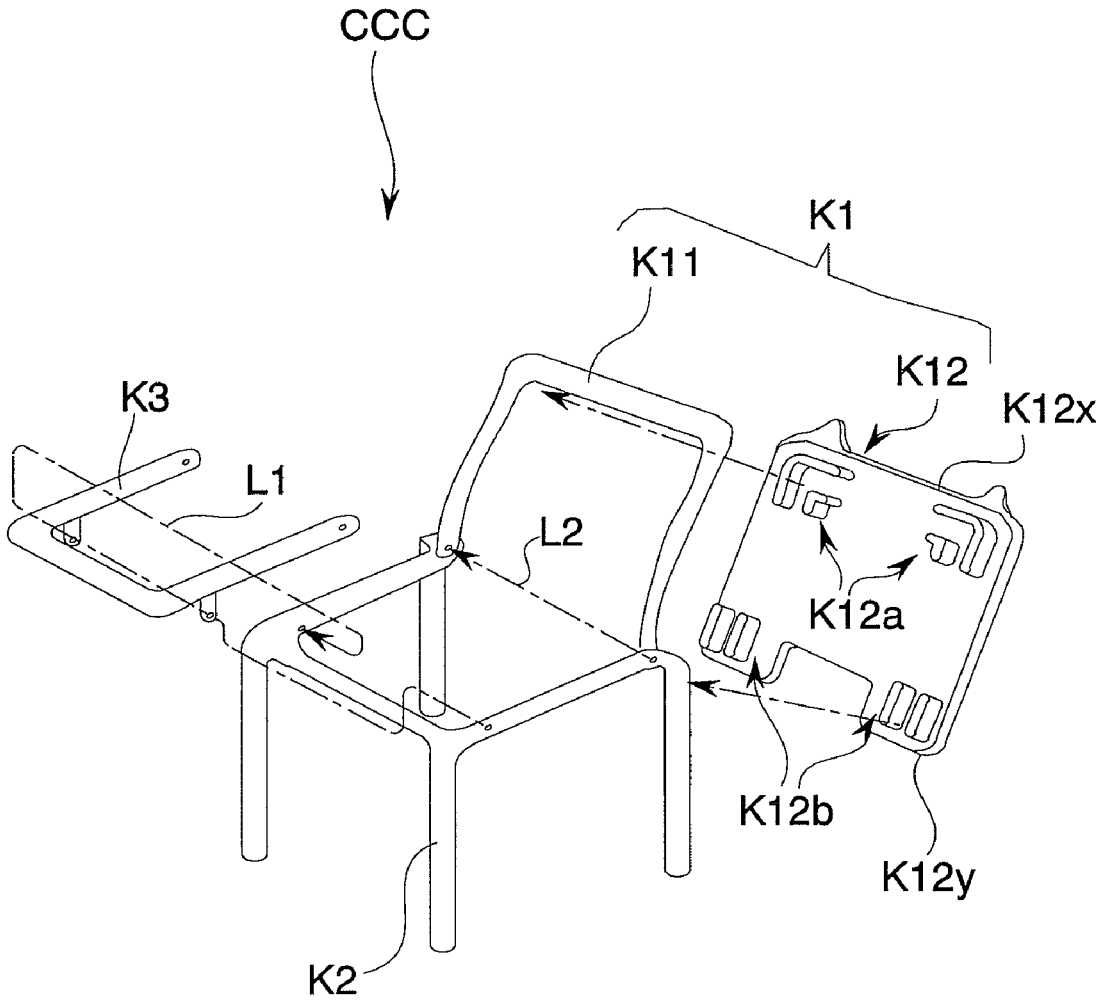
FIG. 19 is an exploded perspective view of the chair according to other embodiment of the present invention.

As shown with a schematic perspective view in FIG. 18, in a chair frame structure comprising a base body J2 having back frame elements J11*a*, J11*b* and a horizontal supporting shaft J22 to which bottom end portions of the back frame elements J11*a*, J11*b* are pivoted, a seat J3 whose rear end portions are supported by the back frame elements J11*a*, J11*b* and leg body J4 which supports the base body J2, a structure described below may be adopted. In the meantime, in this frame structure, a front end portion of the seat J3 is pivoted to the horizontal supporting shaft J22 in order to realize a rocking motion which interlocks the seat with the back and a rear end portion of the seat J3 is connected to the back frame elements J11*a*, J11*b* through a seat rear portion pivoting shaft J31.

That is, the base body J2 is comprised of substantially letter T shaped base body main body J21 which is fixed to a top end of the leg body J4 and the horizontal supporting shaft J22. Reaction force frame elements J151*a*, J151*b*, which are frame-like spring members, are extended from right and left ends of the base body main body J21 and top end portions, which are one end portions of the reaction force frame elements J151*a*, J151*b*, are connected to back frame elements J11*a*, J11*b*, which are first members. Because bottom end portions J152*a*, J152*b*, which are the other end portions of the reaction force frame elements J151*a*, J151*b*, are connected to the base body J2 integrally, the base body functions as a second member in claims. Then, the reaction force frame elements J151*a*, J151*b* extend along the bottom portion of the back frame elements.

In this embodiment, the base portion J2 and the reaction force frame elements J151*a*, J151*b* are formed of for example, spring steel material.

When this embodiment is adopted, a structure in which the reaction force frame elements J151*a*, J151*b* provide a reaction force to the backrest as the backrest having the back frame elements J11*a*, J11*b* is tilted backward can be achieved without forming a construction near the horizontal supporting shaft H22 in which the back frame elements J11*a*, J11*b* and the base body J2 are pivoted in an unnaturally large diameter.

Additionally, because in this embodiment, the reaction force frame elements J151*a*, J151*b* and the base body J2 are formed integrally and the rear end portion of the seat J3 is connected to the back frame elements J11*a*, J11*b* through the seat rear portion pivoting shaft J31, the base body J2 can achieve reaction force rocking mechanism as a simple structure having only the base body main body J21 and the horizontal supporting shaft J22.

In the meantime, it is permissible to form the reaction force frame elements J151*a*, J151*b* and the base body J2 separately and connect the reaction force frame elements J151*a*, J151*b* to the base body J2 with screws. In this case, the reaction force frame elements J151*a*, J151*b* may be formed of other material than spring steel, and for example, resin and the base body J2 may be formed of other material than spring steel, for example, regular steel material.

Additionally, in a chair CCC comprising a backrest K1 having a back frame K11, a base body K2 stood from a floor face and a seat K3 in which a front end portion is pivoted to the base body K2 while the rear end portion is pivoted to the back frame K11, a following structure may be adopted. In the meantime, the base body K2 has leg portions stood from the floor face at four corners and a distance between the front end legs is set smaller than a distance between rear end legs so as to allow the chairs CCC to be stored in an overlaid condition.

That is, this chair CCC adopts a structure in which a top end portion K12*x* as an end portion of the reaction force shell K12 which is a spring member extending along the back frame is connected to the back frame K11 as a first member and a bottom end portion K12*y* as the other end portion of the reaction force shell K12 is connected to the base body K2 as a second member. More specifically, a first engaging portion K12*a* capable of engaging a top end portion of the back frame K11 is provided on the top end portion K12 of the reaction force shell K12 and a second engaging portion K12*b* capable of engaging the base body K2 is provided on the bottom end portion K12*y* of the reaction force shell K12. In the meantime, this reaction force shell K12 is formed entirely of resin. Then, as the backrest K1 is tilted backward, this reaction force shell K12 is elastically deformed to provide a reaction force to the backrest K1.

With such an embodiment also, a structure in which the seat back K11 is supplied with a reaction force by the reaction force shell K12 as the seat back K1 having the back frame K11 is tilted backward can be achieved without forming a construction near a portion in which the back frame K11 and the base body K2 are pivoted in an unnaturally large diameter.

Additionally, because the reaction force is supplied by the reaction force shell K12, the reaction force rocking mechanism can be achieved with a simple structure without adding any special member for supplying the reaction force. Further, because this structure enables the back frame, reaction force shell and the frame constituting the seat to be formed thinly, this embodiment can be applied to other type chair having a structure allowing them to be stored by being stacked vertically.

Further, as other embodiment which enables a first member and a second member to be moved relative to each other with an end portion of a spring member connected to the first member and the other end portion connected to the second member, although not shown, an embodiment that the first and second members are provided with stiffness and at least one of the first and second members is supported with a spring member without pivoting the first and second members may be adopted.

The present invention can be applied to not only the backrest of the chair but also general furniture having a structure in which a frame-like member as a first member and a second member are provided movably relative to each other while the frame-like member is urged in a direction.

The spring member may be formed of spring steel material instead of resin. Further, it may be a material obtained by coating the spring steel material with resin or the like.

Other than this, various modifications are possible within the range without departing from the scope of the present invention.

What is claimed is:

1. A structure for connecting members, comprising:

a first member having stiffness;

a second member movable relative to the first member and having stiffness; and a spring member having a first end portion connected to a rear portion of the first member and a second end portion connected to a rear portion of the second member so as to accumulate a reaction force by elastic deformation, wherein the spring member is formed into a frame shape extending along the first and second members, wherein at least a portion of the spring member is spaced from said first and second members, wherein the first member is a base body which supports a seat and a backrest of a chair, wherein the second member is a back frame including left and right frame elements and constituting at least part of the backrest of the chair, and wherein each of the left and right frame elements are capable of tilting independently relative to said base body.

2. The structure for connecting members of claim 1, wherein the spring member is disposed substantially parallel to the first member and the second member.

3. The structure for connecting members of claim 1, wherein the first member and the second member are pivotable relative to each other at end portions thereof

4. The structure for connecting members of claim 2, wherein the first member and the second member are pivotable relative to each other at end portions thereof.

* * * * *